US007432906B2

(12) United States Patent
Nakajima et al.

(10) Patent No.: US 7,432,906 B2
(45) Date of Patent: Oct. 7, 2008

(54) TIMING GENERATION CIRCUIT FOR DISPLAY APPARATUS AND DISPLAY APPARATUS INCORPORATING THE SAME

(75) Inventors: Yoshiharu Nakajima, Kanagawa (JP); Yasuhito Maki, Kanagawa (JP); Toshikazu Maekawa, Kanagawa (JP)

(73) Assignee: Sony Corporation (JP)

( * ) Notice: Subject to any disclaimer, the term of this patent is extended or adjusted under 35 U.S.C. 154(b) by 569 days.

(21) Appl. No.: 11/086,433

(22) Filed: Mar. 23, 2005

(65) Prior Publication Data

US 2005/0168428 A1 Aug. 4, 2005

Related U.S. Application Data

(63) Continuation of application No. 10/182,600, filed as application No. PCT/JP01/10687 on Dec. 6, 2001, now Pat. No. 6,894,674.

(51) Int. Cl.
*G09G 3/36* (2006.01)

(52) U.S. Cl. ..... 345/100; 345/98; 345/205

(58) Field of Classification Search ..... 345/98, 345/99, 80, 205, 96, 100; 327/208
See application file for complete search history.

(56) References Cited

U.S. PATENT DOCUMENTS

| | | | | |
|---|---|---|---|---|
| 4,430,648 | A | 2/1984 | Togashi et al. | |
| 5,654,659 | A * | 8/1997 | Asada | 327/208 |
| 5,754,155 | A | 5/1998 | Kubota et al. | |
| 5,986,649 | A | 11/1999 | Yamazaki | |
| 6,147,451 | A | 11/2000 | Shibata et al. | |
| 6,166,714 | A | 12/2000 | Kishimoto | |
| 6,225,969 | B1 | 5/2001 | Ishii | |
| 6,538,633 | B1 | 3/2003 | Ito | |
| 6,580,411 | B1 * | 6/2003 | Kubota et al. | 345/98 |
| 6,727,875 | B1 | 4/2004 | Mikami et al. | |

FOREIGN PATENT DOCUMENTS

| | | |
|---|---|---|
| EP | 0 629 868 A1 | 12/1994 |
| JP | 2-35492 | 2/1990 |
| JP | 7-287208 | 10/1995 |

(Continued)

OTHER PUBLICATIONS

JP07-287208 (Sony-208) computer translation.

(Continued)

*Primary Examiner*—Sumati Lefkowitz
*Assistant Examiner*—Yong Sim
(74) *Attorney, Agent, or Firm*—Rader Fishman & Grauer PLLC; Ronald P. Kananen

(57) ABSTRACT

A timing generation circuit (15) is formed integrally on the same glass substrate (11) together with a display area section (12) similarly to an H driver (13U) and a V driver (14), and timing pulses to be used by the H driver (13U) and the V driver (14) are produced based on timing data produced by a shift register (31U) of the H driver (13U) and a shift register (14A) of the V driver (14). The invention thereby provides a timing generation circuit which can contribute to miniaturization and reduction of the cost of the set and a display apparatus of the active matrix type in which the timing generation circuit is incorporated.

5 Claims, 23 Drawing Sheets

FOREIGN PATENT DOCUMENTS

| | | |
|---|---|---|
| JP | 7-287553 | 10/1995 |
| JP | 8-166775 | 6/1996 |
| JP | 8-201763 | 8/1996 |
| JP | 2000-75842 | 3/2000 |
| JP | 2000-122575 | 4/2000 |
| JP | 2000-122616 | 4/2000 |
| JP | 2000-187470 | 7/2000 |
| JP | 2000-227585 | 8/2000 |
| JP | 2000-227608 | 8/2000 |
| JP | 2000-231124 | 8/2000 |
| JP | 2000-305527 | 11/2000 |
| JP | 2000-333444 | 11/2000 |
| JP | 2001-343945 | 12/2001 |

OTHER PUBLICATIONS

JP 2000-075842 (Sony-842) translation.
JP 2000-305527 (Seiko-527) translation.
JP 2000-227608 (Hitachi) translation.
JP08-166775 (Sharp) translation.
JP 2000-122575 (Casio) translation.
International Search Report.
Supplemental European Search Report dated Jun. 6, 2008 for corresponding European Application No. 01 99 9936.

* cited by examiner

TIMING GENERATION CIRCUIT FOR DISPLAY APPARATUS AND DISPLAY APPARATUS INCORPORATING THE SAME

This is a continuation application of Ser. No. 10/182,600, filed on Jul. 31, 2002, now U.S. Pat. No. 6,894,674 which is a 371 of PCT/JP01/10687, filed Dec. 6, 2001, the entire contents of which are hereby incorporated by reference.

TECHNICAL FIELD

This invention relates to a timing generation apparatus for a display apparatus and a display apparatus in which the timing generation circuit is incorporated, and more particularly to a timing generation circuit which generates various timing pulses for controlling a driving system of a display apparatus of the active matrix type and a display apparatus of the active matrix type in which the timing generation circuit is incorporated.

BACKGROUND ART

In recent years, portable terminals such as portable telephone sets and PDA (Personal Digital Assistants) have been popularized remarkably. One of factors of such rapid popularization of portable terminals is considered a liquid crystal display apparatus incorporated as an output display section of the portable terminals. The reason is that the liquid crystal display apparatus has a characteristic that high power for driving the same is not required in principle and is a display device of low power consumption.

A display apparatus of a configuration wherein pixels are disposed in rows and columns (in a matrix) and are driven individually such as liquid crystal display apparatus as described above includes a vertical driving system for selecting the pixels in a unit of a row and a horizontal driving system for writing information into each of the pixels of the row selected by the vertical driving system. Various timing pulses for driving control of the driving systems are used by them.

The timing pulses are generated at suitable timings based on a horizontal synchronizing signal HD, a vertical synchronizing signal VD and a master clock signal MCK using a timing signal producing counter circuit for exclusive use or the like. The timing pulse generation circuit for generating the timing pulses is conventionally formed on a single crystal silicon substrate which is separate from a substrate on which a display area section is formed.

Where, in a display apparatus represented by a liquid crystal display apparatus, a timing generation circuit for generating various timing signals to be used for display driving is formed on a substrate separate from a substrate on which a display area section is formed as described above, the number of parts for forming the set increases and they must be produced through separate processes. Therefore, there is a problem that miniaturization and reduction of the cost of the set are obstructed.

Therefore, it is an object of the present invention to provide a timing generation circuit for a display apparatus which can contribute to miniaturization and reduction of the cost of a set and a display apparatus in which the timing generation circuit is incorporated.

DISCLOSURE OF INVENTION

In order to attain the object described above, according to the present invention, in a display apparatus which includes a display area section wherein pixels each having an electro-optical element are disposed in rows and columns, a vertical driving circuit for selecting the pixels of the display area section in a unit of a row, and a horizontal driving circuit for supplying an image signal to each of the pixels in the row selected by the vertical driving circuit, a timing generation circuit is configured such that it produces a timing signal to be used by at least one of the vertical driving circuit and the horizontal driving circuit based on timing information produced by at least one of the vertical driving circuit and the horizontal driving circuit.

That a timing signal is generated based on timing information produced by at least one of the vertical driving circuit and the horizontal driving circuit in the timing generation circuit of the configuration described above or in a display apparatus in which the timing generation circuit is incorporated signifies that part of at least one of the vertical driving circuit and the horizontal driving circuit is used for production of the timing signal. Accordingly, the circuit configuration of the timing generation circuit can be simplified by the circuit portion used also for the production of the timing signal.

BEST MODE FOR CARRYING OUT THE INVENTION

In the following, embodiments of the present invention are described in detail with reference to the drawings.

Figure 1:
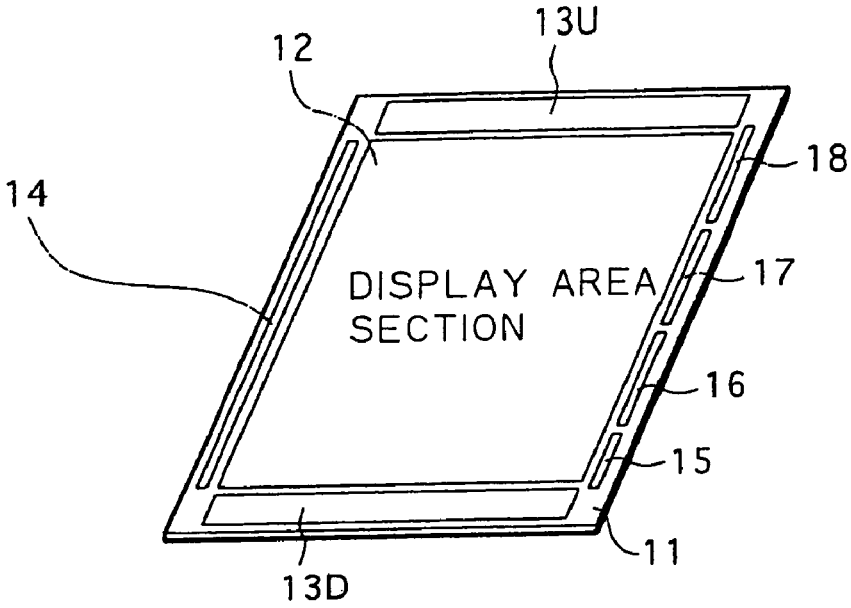
FIG. 1 is a view of a schematic configuration showing an example of a configuration of a display apparatus according to the present invention.

FIG. 1 is a view of a schematic configuration showing an example of a configuration of a display apparatus according to the present invention. Here, description is given taking, as an example, a case wherein the present invention is applied to a liquid crystal display apparatus of the active matrix type in which a liquid crystal cell is incorporated as an electro-optical element of each pixel.

Referring to FIG. 1, a display area section 12 wherein a large number of pixels each including a liquid crystal cell are disposed in a matrix is formed on a transparent insulation substrate, for example, a glass substrate 11. The glass substrate 11 is formed from a first substrate wherein a large number of pixel circuits each including an active device (for example, a transistor) are disposed in rows and columns and a second substrate disposed in an opposing relationship to the first substrate with a predetermined gap left therebetween. A liquid crystal material is enclosed in a space between the first and second substrates to form a liquid crystal display panel.

Figure 2:
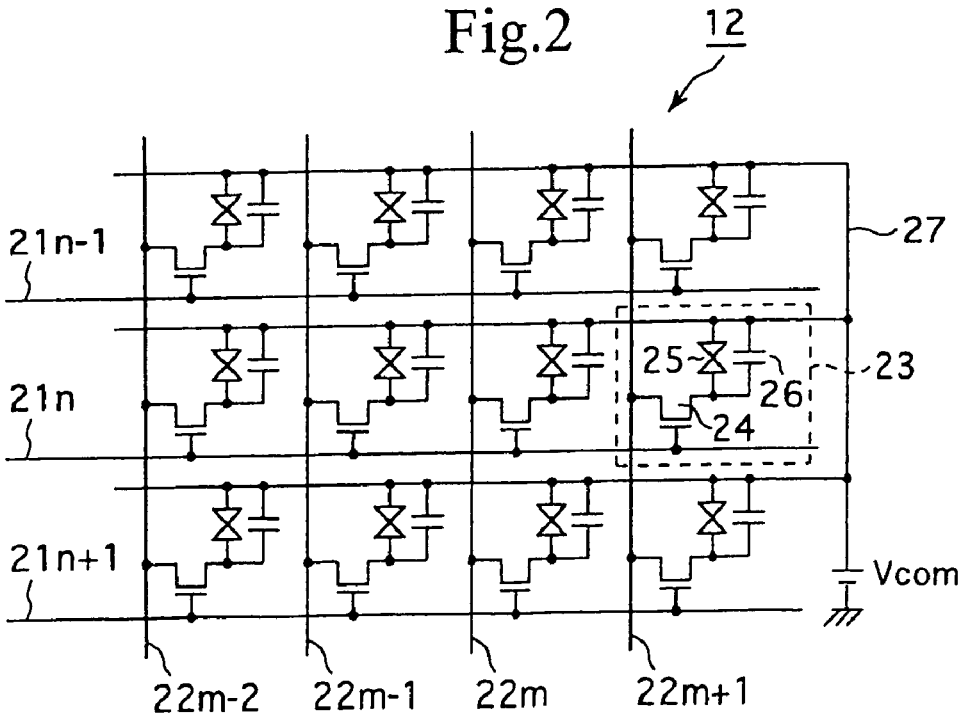
FIG. 2 is a circuit diagram showing an example of a configuration of a display area section of a liquid crystal display apparatus.

An example of a particular configuration of the display area section 12 is shown in FIG. 2. Here, in order to simplify the drawing, a pixel arrangement of three rows (n−1th row to n+1th row) and four columns (m−2th column to m+1th column) is shown as an example. In FIG. 2, vertical scanning lines . . . , 21$n$−1, 21$n$, 21$n$+1, . . . , and data lines . . . , 22$m$−2, 22$m$−1, 22$m$, 22$m$+1, . . . are wired in a matrix, and a unit pixel 23 is disposed at each of intersection points of the vertical scanning lines and the data lines.

The unit pixel 23 includes a thin film transistor (Thin Film Transistor; TFT) 24 which is a pixel transistor, a liquid crystal cell 25 which is an electro-optical element and a storage capacitor 26. Here, the liquid crystal cell 25 signifies a liquid crystal capacitor which is produced between a pixel electrode formed from the thin film transistor (hereinafter referred to as TFT) 24 and a counter-electrode formed in an opposing relationship to the pixel electrode.

The gate electrode of the TFT 24 is connected to the vertical scanning lines . . . , 2l$n$−1, 21$n$, 21$n$+1, . . . , and the source electrode of the TFT 24 is connected to-the data lines . . . , 22$m$−2, 22$m$−1, 22$m$, 22$m$+1, . . . . The pixel electrode of the liquid crystal cell 25 is connected to the drain electrode of the TFT 24 and the counter-electrode of the liquid crystal cell 25 is connected to a common line 27. The storage capacitor 26 is connected between the drain electrode of the TFT 24 and the common line 27. A counter-electrode voltage (common voltage) Vcom is supplied to the common line 27. Consequently, the common voltage Vcom is applied to the counter-electrode of the liquid crystal cell LC commonly to the pixels.

On the glass substrate 11, a pair of upper and lower H drivers (horizontal driving circuits) 13U and 13D and a V driver (vertical driving circuit) 14 are formed integrally together with the display area section 12. One terminal of each of the vertical scanning lines . . . , 21$n$−1, 21$n$, 21$n$+1, . . . of the display area section 12 is connected to an output terminal of the V driver 14 for a corresponding one of the rows.

The V driver 14 is formed from, for example, a shift register, and successively generates a vertical selection pulse in synchronism with a vertical transfer clock VCK (not shown) and applies it to the vertical scanning lines . . . , 21$n$−1, 21$n$, 21$n$+1, . . . to perform vertical scanning. Meanwhile, in the display area section 12, for example, one terminal of each of the odd numbered data lines . . . , 21$m$−1, 21$m$+1, . . . is connected to an output terminal of the H driver 13U for a corresponding one of the columns and each of the other ends of the even numbered data lines . . . , 22$m$−2, 22$m$, . . . is connected to an output terminal of the H driver 13D for a corresponding one of the columns.

In the liquid crystal display apparatus of the active matrix type, if a scanning signal is supplied from the V driver 14 to the vertical scanning lines . . . , 21$n$−1, 21$n$, 21$n$+1, . . . , then the resistance between the drain electrode and the source electrode of the TFT 24 of each of the pixels connected to the vertical scanning lines becomes low, and the voltage supplied in response to an image signal from each of the H drivers 13U and 13D through each of the data lines . . . , 22$m$−2, 22$m$−1, 22$m$, 22$m$+1, . . . is applied to the pixel electrode of the liquid crystal cell. Then, modulation of an optical characteristic of the liquid crystal material enclosed between the pixel electrode and the counter-electrode is performed with the voltage to display an image.

Figure 3:
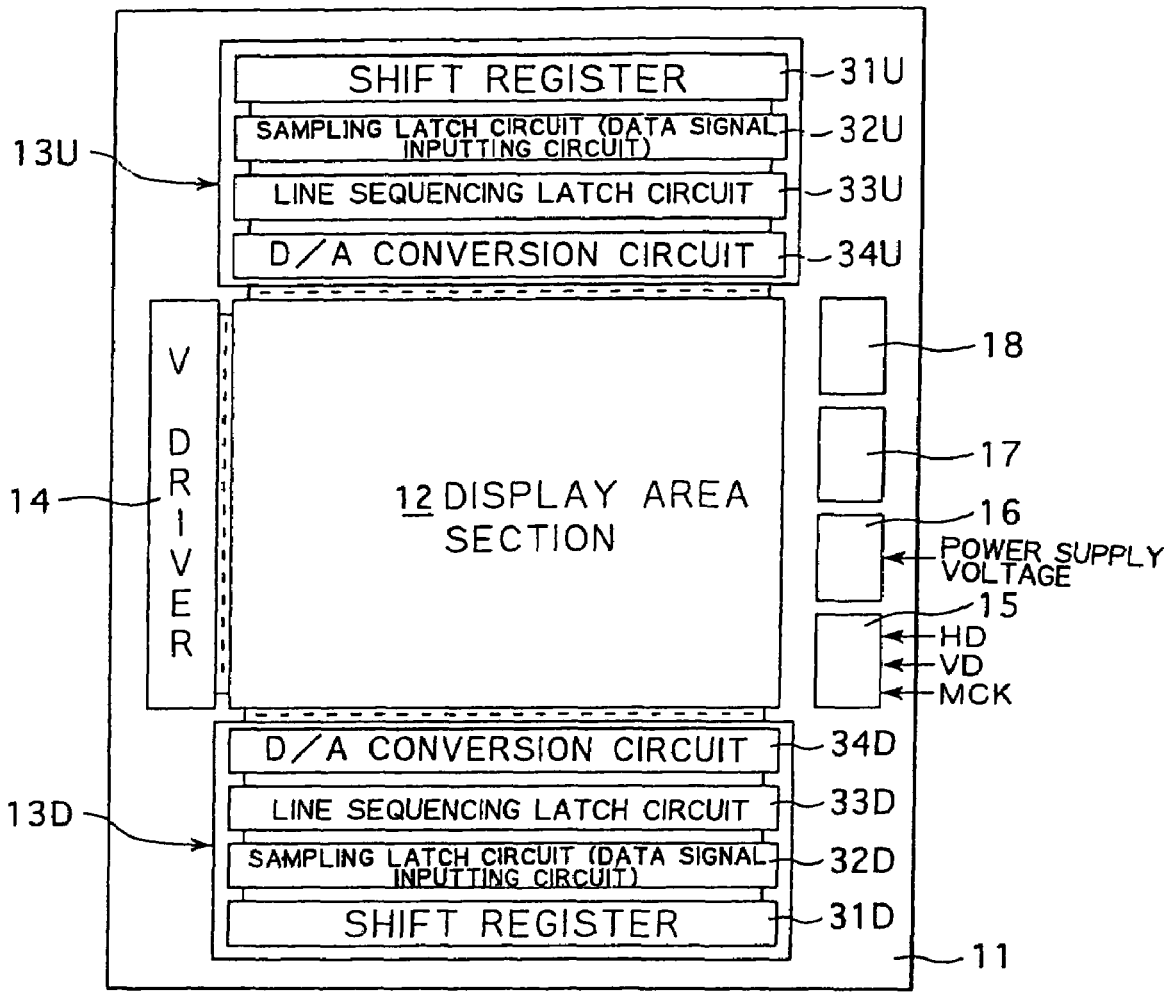
FIG. 3 is a block diagram showing an example of a particular configuration of an H driver.

An example of a particular configuration of the H drivers 13U and 13D is shown in FIG. 3. As shown in FIG. 3, the H driver 13U includes a shift register 31U, a sampling latch circuit (data signal inputting circuit) 32U, a line sequencing latch circuit 33U, and a D/A conversion circuit 34U. The shift resister 31U sequentially outputs a shift pulse from each transfer stage thereof in synchronism with a horizontal transfer clock HCK (not shown) to perform horizontal scanning. The sampling latch circuit 32U samples, in point sequence, digital image data of predetermined bits inputted in response to the shift pulse supplied thereto from the shift register 31U to latch the digital image data.

The line sequencing latch circuit 33U latches the digital image data latched in point sequence by the sampling latch circuit 32U in a unit of one line again to perform line sequencing, and outputs the digital image data for one line at a time. The D/A conversion circuit 34U has a configuration of, for example, a circuit of the reference voltage selection type, and converts the digital image data for one line outputted from the line sequencing latch circuit 33U into an analog image signal and supplied it to the data lines . . . , 22$m$−2, 22$m$−1, 22$m$, 22$m$+1, of the pixel area section 12.

Also the lower side H driver 13D includes a shift register 31D, a sampling latch circuit 32D, a line sequencing latch circuit 33D, and a D/A conversion circuit 34D of the reference voltage selection type, quite similarly to the upper side H driver 13U. It is to be noted that, while the liquid crystal display apparatus of the active matrix type according to the present example adopts the configuration wherein the H drivers 13U and 13D are disposed on the upper and lower sides of the display area section 12, the liquid crystal display apparatus of the active matrix type is not limited to this but can adopt another configuration wherein the H drivers 13U and 13D are disposed on only one of the upper and lower sides of the display area section 12.

Also peripheral circuits such as a timing generation circuit 15, a power supply circuit 16, a counter-electrode voltage generation circuit 17 and a reference voltage generation circuit 18 are formed integrally (integrated) together with the display area section 12 on the glass substrate 11 similarly to the H drivers 13U and 13D and the V driver 14. Upon such integration formation, all of circuit elements which form the circuits mentioned, or at least active elements (or active/passive elements) among them, are produced on the glass substrate 11. Consequently, since no active element (or no active/passive element) is present outside the glass plate 11, the configuration of peripheral elements of the substrate can be simplified and miniaturization and reduction of the cost of the apparatus can be anticipated.

Here, for example, where the liquid crystal display apparatus has a configuration wherein the H drivers 13U and 13D are disposed on the upper and lower sides of the display area section 12, preferably the peripheral circuits such as the timing generation circuit 15, power supply circuit 16, counter-electrode voltage generation circuit 17 and reference voltage generation circuit 18 are disposed in a frame area (peripheral area of the display area section 12) on a side or sides on which the H drivers 13U and 13D are not disposed.

The reason is that, since the H drivers 13U and 13D include a great number of components when compared with the V driver 14 as described above and in most cases have a very great circuit area, where they are disposed in the frame area on a side or sides on which the H drivers 13U and 13D are not disposed, the peripheral circuits such as the timing generation circuit 15, power supply circuit 16, counter-electrode voltage generation circuit 17 and reference voltage generation circuit 18 can be integrated on the same glass substrate 11 as that of the display area section 12 without deteriorating the effective screen ratio (the area ratio of the effective area section 12 to the glass substrate 11).

The liquid crystal display apparatus of the active matrix type according to the present example adopts the configuration wherein, since the V driver 14 is mounted on one side of the frame area on the sides on which the H drivers 13U and 13D are not disposed, the peripheral circuits such as the timing generation circuit 15, power supply circuit 16, counter-electrode voltage generation circuit 17 and reference voltage generation circuit 18 are mounted in the frame area on the opposite side to the one side.

First Embodiment

Figure 4:
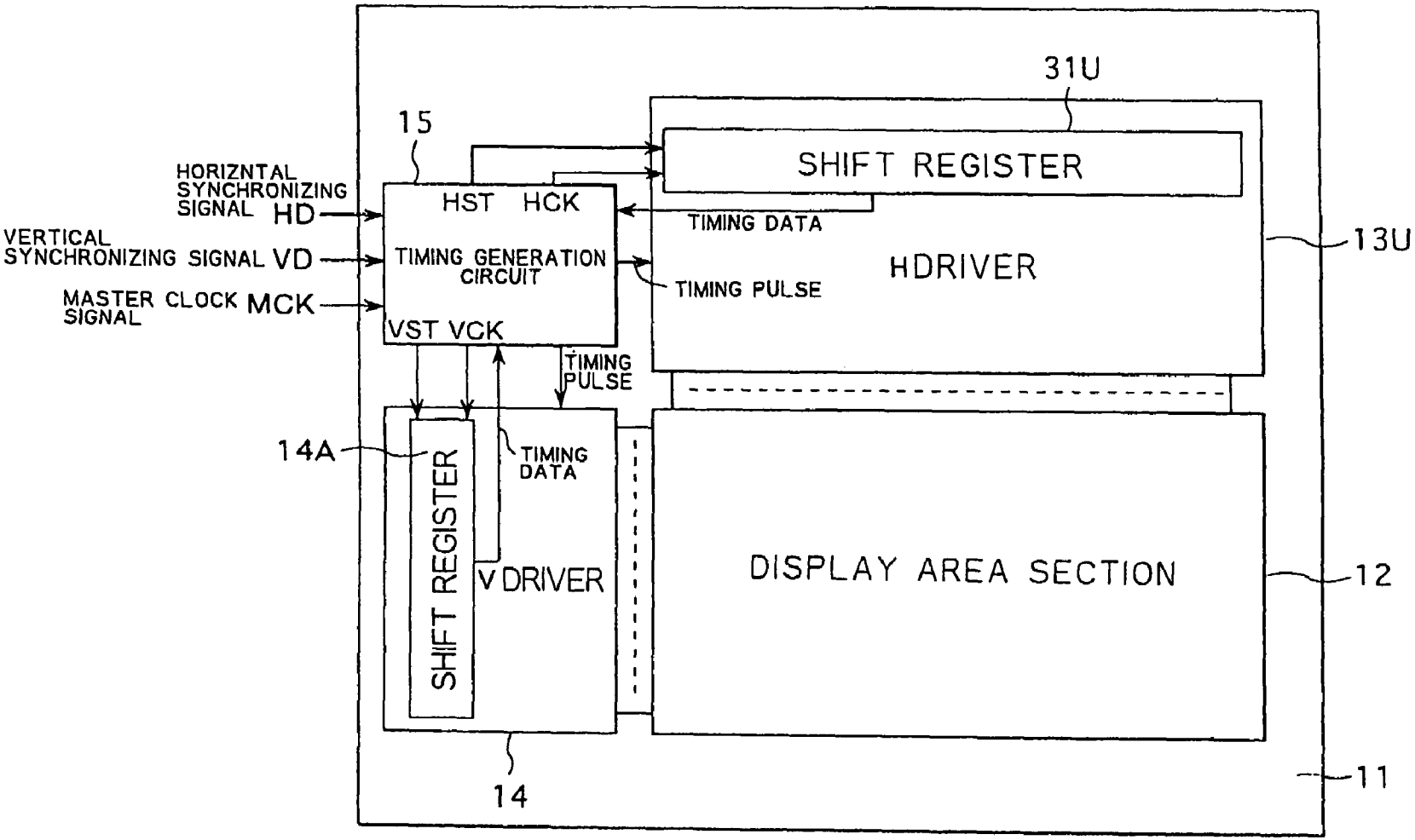
FIG. 4 is a block diagram showing an example of a configuration of a display apparatus of the active matrix type according to a first embodiment of the present invention.

FIG. 4 is a block diagram showing an example of a configuration of a display apparatus of the active matrix type according to a first embodiment of the present invention. Here, only an H driver 13U on the upper side is shown for simplification of the drawing. However, also a relationship to another H driver 13D on the lower side is similar to that to the H driver 13U.

A timing generation circuit 15 receives a horizontal synchronizing signal HD, a vertical synchronizing signal VD and a master clock MCK supplied thereto from the outside as inputs thereto, and first generates, with reference to the input signals, a horizontal start pulse HST and a horizontal transfer clock HCK to be provided to a shift register 31U of the H driver 13U and a vertical start pulse VST and a vertical transfer pulse VCK to be provided to a shift register 14A of a V driver 14.

Here, the horizontal start pulse HST is a pulse signal generated after lapse of a predetermined period of time after generation of the horizontal synchronizing signal HD, and the horizontal transfer clock HCK is a pulse signal obtained, for example, by dividing the master clock MCK. The vertical start pulse VST is a pulse signal generated after lapse of a predetermined period of time after generation of the vertical synchronizing signal VD, and the vertical transfer pulse VCK is a pulse signal obtained, for example, by dividing the horizontal transfer clock HCK.

Accordingly, the circuit in the timing generation circuit 15 for generating the horizontal start pulse HST, horizontal transfer clock HCK, vertical start pulse VST and vertical transfer pulse VCK with reference to the horizontal synchronizing signal HD, vertical synchronizing signal VD and master clock MCK can be implemented with a simple counter circuit having several-stages.

The timing generation circuit 15 is further configured such that it receives, as inputs thereto, timing data obtained from a suitable transfer stage of the shift register 31U of the H driver 13U and timing data (timing information) obtained from a suitable transfer stage of the shift register 14A of the V driver 14 as well and generates a timing pulse to be used by the H driver 13U and a timing pulse to be used by the V driver 14 with reference to the inputted timing data.

Here, as the timing pulse to be used by the H driver 13U, a latch control pulse to be used by a line sequencing latch circuit 33U shown in FIG. 3 is available as an example. However, the timing pulse is not limited to this. Meanwhile, as the timing pulse to be used by the V driver 14, a display period control pulse for specifying a display period when the display apparatus is in a partial display mode wherein displaying is performed only for a certain period in a vertical direction of a display area section 12 is available as an example. However, the timing pulse is not limited to this.

Figure 5:
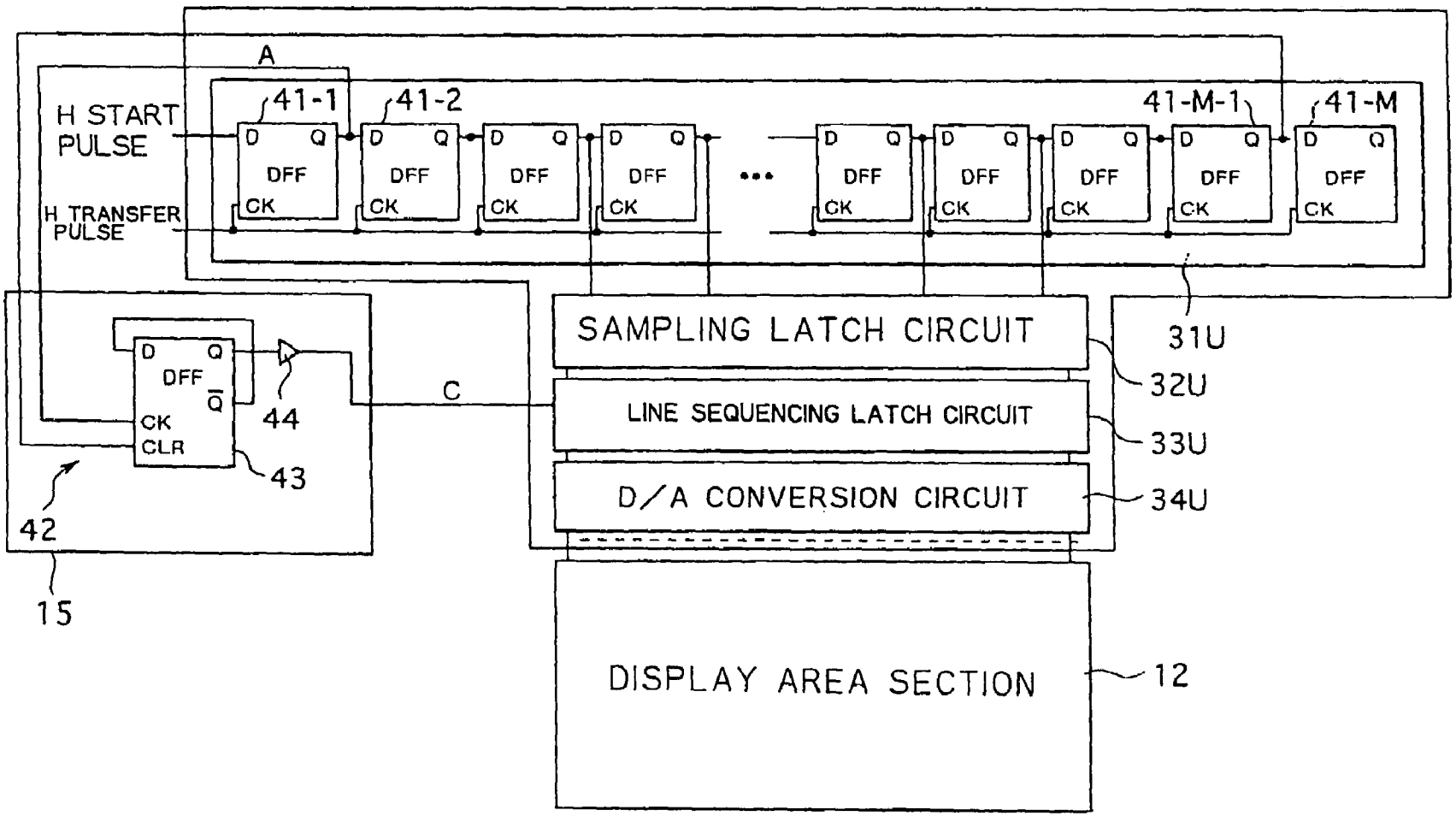
FIG. 5 is a block diagram showing an example of a particular configuration of a timing generation circuit.

FIG. 5 is a block diagram showing an example of a particular configuration of the timing generation circuit 15. Here, description is given taking a case wherein the timing generation circuit 15 generates a latch control pulse to be used by the line sequencing latch circuit 33U is generated based on timing data supplied thereto from the shift register 31U of the H driver 13U as an example.

Referring to FIG. 5, the shift register 31U of the H driver 13U includes M stages of D-type flip-flops (hereinafter referred to as DFFs) 41-1 to 41-M greater than the pixel number N of the display area section 12 in the horizontal direction. The shift register 31U of the configuration just described performs a shifting operation in synchronism with the horizontal transfer clock HCK when the horizontal start pulse HST is supplied thereto. As a result, a sequential pulse (timing information) is outputted in synchronism with the horizontal transfer clock HCK from each of the Q output terminals of the DFFs 41-1 to 41-M.

The Q output pulses of the DFFs 41-1 to 41-M are successively supplied as sampling pulses to a sampling latch circuit 32U. Further, those ones of the Q output pulses of the DFFs 41-1 to 41-M at suitable transfer stages, here as an example, the Q output pulse A of the DFF 41-1 at the first stage and the Q output pulse B of the DFF 41-M at the M−1th stage, are supplied to the timing generation circuit 15.

In the timing generation circuit 15, a latch control pulse generation circuit 42 for generating the latch control pulse includes, for example, a DFF 43 and a buffer 44. The DFF 43 receives the Q output pulse A of the DFF 41-1 at the first stage supplied from the shift register 31U as a clock (CK) input thereto and receives the Q output pulse B of the DFF 41-M-1 at the M−1th stage as a clear (CLR) input thereto, and further receives the inverted Q output of the DFF 43 itself as a data (D) input thereto.

Figure 6:
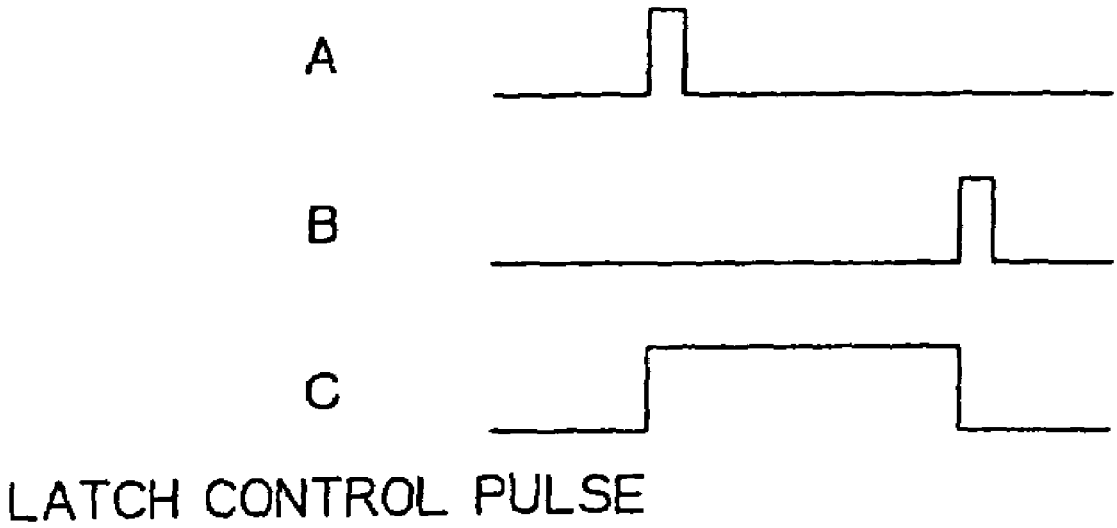
FIG. 6 is a timing chart illustrating operation of the timing generation circuit.

Consequently, as can be seen apparently from a timing chart of FIG. 6, a pulse which exhibits the "H"°level (high level) within a period after the timing of a rising edge of the Q output pulse A of the DFF 41-1 until the timing of a rising edge of the Q output pulse B of the DFF 41-M-1 is obtained as a latch control pulse C from the Q output terminal of the DFF 43 through the buffer 44.

As described above, in the timing generation circuit 15 for a display apparatus, for generation of timing pulses to be used by the H drivers 13U and 13D and V driver 14, the shift registers 31U and 31D of the H drivers 13U and 13D and the shift register 14A of the V driver 14 are used commonly and the timing pulses are generated based on timing data obtained from the shift registers. Therefore, the necessity for a circuit for exclusive use such as a counter circuit is eliminated, and the circuit configuration can be simplified. Consequently, miniaturization, reduction in cost and reduction in power consumption of the set can be achieved.

Particularly where the timing generation circuit 15 is formed integrally on the same glass substrate 11 together with the display area section 12 similarly to the H drivers 13U and 13D and the V driver 14, since the circuit configuration of the timing generation circuit 15 is very simple and the power consumption is low, narrowing of the frame, reduction in cost and reduction in power consumption of the display unit can be achieved.

It is to be noted that, while it has been described that, in the present embodiment, the circuit elements for generating the horizontal start pulse HST, horizontal transfer clock HCK, vertical start pulse VST and vertical transfer pulse VCK with reference to the horizontal synchronizing signal HD, vertical synchronizing signal VD and master clock MCK are formed integrally on the glass substrate 11, the circuit elements mentioned may otherwise be formed on a separate substrate from the glass substrate 11. This is because, since the circuit elements can be implemented using a simple counter circuit, even if they are formed on a separate substrate, the configuration of the peripheral circuit is not complicated very much.

Further, while it has been described that the present embodiment premises the configuration wherein the H drivers 13U and 13D and the V driver 14 are formed using a shift register, the present invention is not limited to the case wherein a shift register is used, but can be applied similarly to another configuration wherein different types of counter circuits are used for the H drivers 13U and 13D and the V driver 14 only if they effect address control of the H drivers 13U and 13D and the V driver 14 and perform a counting operation for generating timing data.

Second Embodiment

Figure 7:
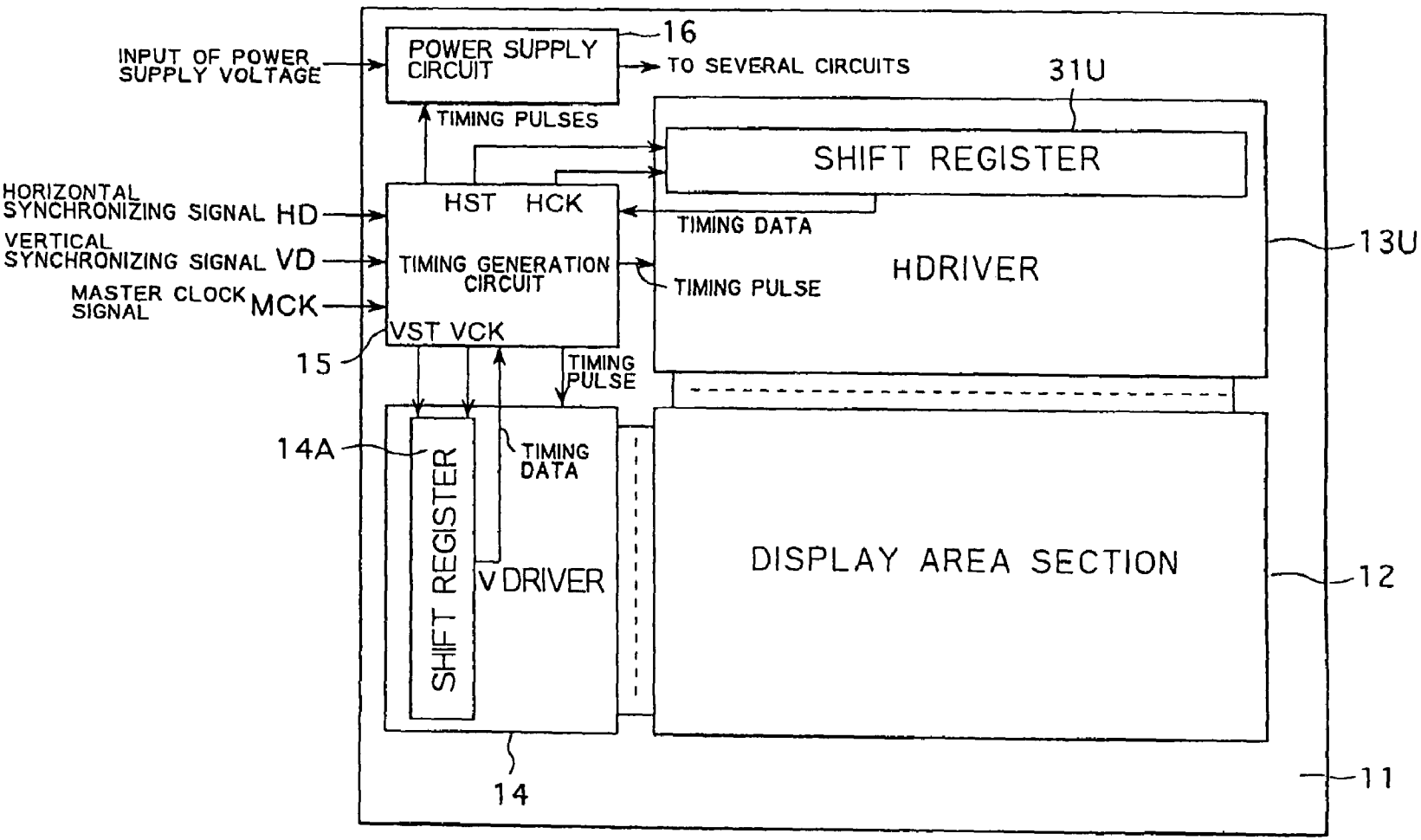
FIG. 7 is a block diagram showing an example of a configuration of a display apparatus of the active matrix type according to a second embodiment of the present invention.

FIG. 7 is a block diagram showing an example of a configuration of a display apparatus of the active matrix type according to a second embodiment of the present invention, and in FIG. 7, like elements to those of FIG. 4 are denoted by like reference characters. Also here, only an H driver 13U on the upper side is shown for simplification of the drawing. However, also a relationship to another H driver 13D on the lower side is similar to that to the H driver 13U.

The display apparatus of the active matrix type according to the present embodiment is configured such that also a timing pulse to be used by a power supply circuit 16 is generated by the timing generation circuit 15. The power supply circuit 16 is formed from, for example, a power supply voltage conversion circuit (DC-DC converter) of the charge pump type, and converts a single DC power supply voltage VCC supplied thereto from the outside into a plurality of different DC voltages having different voltage values from each other and supplies the DC voltages as power supply voltages to internal circuits such as the H drivers 13U and 13D and a V driver 14.

A particular configuration of the power supply circuit 16 is described. Here, description is given taking a case wherein, for example, a power supply voltage conversion circuit of the charge pump type (hereinafter referred to as charge pump type D/D converter) is used as the power supply circuit 16 as an example.

Figure 8:
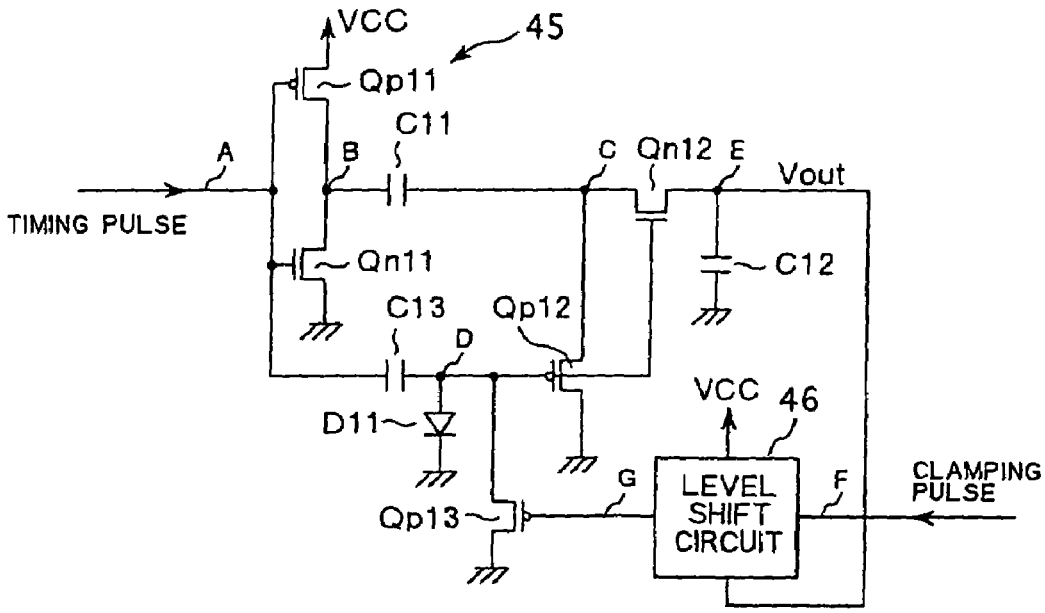
FIG. 8 is a circuit diagram showing an example of a configuration of a charge pump type D/D converter of the negative voltage generation type.

FIG. 8 is a circuit diagram showing a charge pump type D/D converter of the negative voltage generation type. To the charge pump type D/D converter, a clock pulse to be used to perform a switching operation and a clamping pulse to be used to perform a clamping operation are supplied as timing pulses from the timing generation circuit 15.

Referring to FIG. 8, a Pch MOS transistor Qp11 and an Nch MOS transistor Qn11 are connected in series between the power supply from which the single DC power supply voltage VCC is supplied and the ground (GND), and have the gates connected commonly thereby to form a CMOS inverter 45. The timing pulse supplied from the timing generation circuit 15 is applied as a switching pulse to the gate common node of the CMOS inverter 45.

A terminal of a capacitor C11 is connected to a drain common node (node B) of the CMOS inverter 45. The other terminal of the capacitor C11 is connected to the drain of an Nch MOS transistor Qn12 and the source of a Pch MOS transistor Qp12. A load capacitor C12 is connected between the source of the Nch MOS transistor Qn12 and the ground.

A terminal of a capacitor C13 is connected to the gate common node of the CMOS inverter 45. The other terminal of the capacitor C13 is connected to the anode of a diode D11. Further, the gates of the Nch MOS transistor Qn12 and the Pch MOS transistor Qp12 are connected to the other terminal of the capacitor C13. The drain of the Pch MOS transistor Qp12 is grounded.

A Pch MOS transistor Qp13 is connected between the other terminal of the capacitor C13 and the ground. To the gate of the Pch MOS transistor Qp13, the timing pulse supplied from the timing generation circuit 15, that is, the clamping pulse, is supplied after it is level-shifted by a level shift circuit 46. The Pch MOS transistor Qp13 and the level shift circuit 46 form a clamp circuit for clamping a switching pulse voltage for the switching transistors (Nch MOS transistor Qn12 and Pch MOS transistor Qp12).

In the clamp circuit, the level shift circuit 46 uses the DC power supply voltage VCC inputted to the D/D converter as a positive side circuit power supply and uses an output voltage Vout of the D/D converter derived from the opposite terminals of the display area section 12 as a negative side circuit power supply, and level-shifts the clamping pulse of an amplitude VCC−0 [V] supplied from the timing generation circuit 15 to a clamping pulse of another amplitude VCC−Vout [V] and applies the level-shifted clamping pulse to the gate of the Pch MOS transistor Qp13. Consequently, the switching operation of the Pch MOS transistor Qp13 is performed with a higher degree of certainty.

Figure 9:
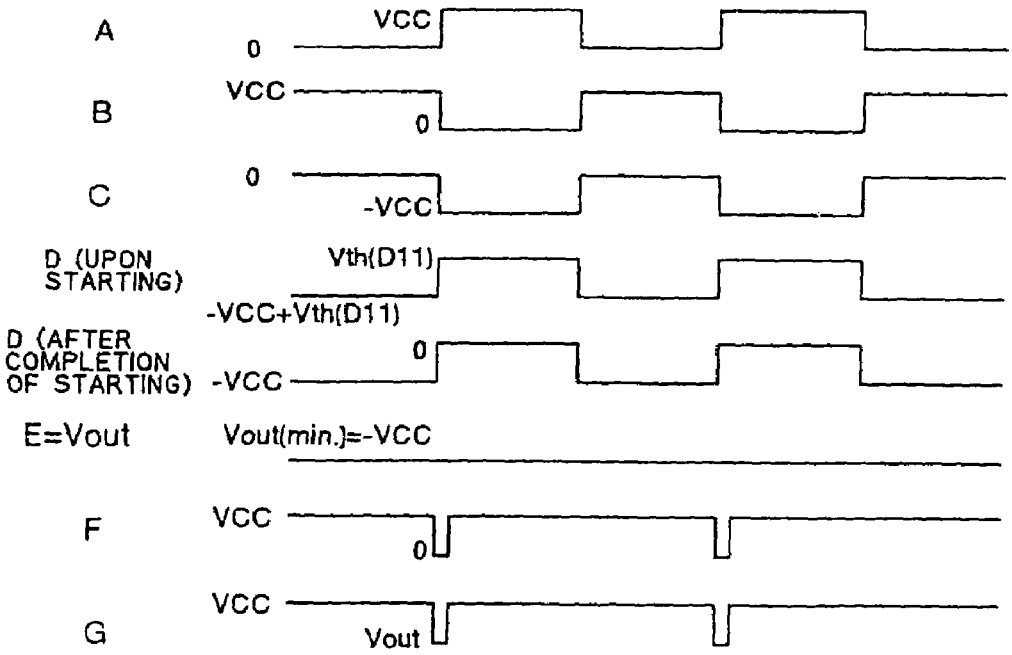
FIG. 9 is a timing chart illustrating operation of the charge pump type D/D converter of the negative voltage generation type.

Now, circuit operation of the charge pump type D/D converter of the negative voltage generation type having the configuration described above is described with reference to a timing chart of FIG. 9. In this timing chart, waveforms A to G represent signal waveforms at the nodes A to G of the circuit of FIG. 8, respectively.

Upon starting of power supply (upon starting), the output potential of the capacitor C13 based on the switching pulse supplied from the timing generation circuit 15, that is, the potential at the node D, is "H"-level-clamped at a potential level-shifted by a threshold voltage Vth of the diode D11 from the ground (GND) level which is the negative side circuit power supply potential.

Then, when the switching pulse has the "L" level (0 V), since the Pch MOS transistors Qp11 and Qp12 exhibit an on state, the capacitor C11 is charged. At this time, since the Nch MOS transistor Qn11 is in an off state, the potential at the node B is equal to the VCC level. Then, when the switching pulse changes to the "H" level (VCC), the Nch MOS transistors Qn11 and Qn12 are placed into an on state and the potential at the node B becomes equal to the ground level (0 V). Consequently, the potential at the node C becomes equal to the −VCC level. The potential at the node C passes as it is through the Nch MOS transistor Qn12 and makes the output voltage Vout (=−VCC).

Then, when the output voltage Vout rises to some degree (upon completion of the starting process), the level shift circuit 46 for the clamping pulse starts its operation. After the level shift circuit 46 starts its operation, the clamping pulse of the amplitude VCC−0 [V] supplied from the timing generation circuit 15 is level-shifted to the claming pulse of the amplitude VCC−Vout [V] by the level shift circuit 46, whereafter it is applied to the gate of the Pch MOS transistor Qp13.

At this time, since the "L" level of the clamping pulse is the output voltage Vout, that is, −VCC, the Pch MOS transistor Qp13 assumes an on state with certainty. Consequently, the potential at the node D is clamped not at the potential level-shifted by the threshold voltage Vth of the diode D11 from the ground level but at the ground level (negative side circuit power supply potential). Consequently, in a later pumping operation of the charge pump circuit, a sufficient driving voltage particularly for the Pch MOS transistor Qp12 is obtained.

In the charge pump type DfD converter of the configuration described above, a clamping operation of the control pulse (switching pulse) voltage for the switching elements (Nch MOS transistor Qn12 and Pch MOS transistor Qp12) provided at the outputting section of the charge pump type D/D converter is performed divisionally in two stages including clamping by the diode D11 first and clamping by the clamp circuit formed from the Pch MOS transistor Qp13 and the level shift circuit 46 after completion of the starting process. Therefore, a sufficient driving voltage particularly for the Pch MOS transistor Qp12 can be obtained.

Consequently, since sufficient switching current is obtained from the Pch MOS transistor Qp12, a stabilized DC-DC conversion operation can be performed and the conversion efficiency can be augmented. Particularly, since sufficient switching current can be obtained even if the transistor size of the Pch MOS transistor Qp12 is not increased, a power supply voltage conversion circuit of high current capacity can be realized with a circuit scale of a small area. This effect is particularly high where a transistor having a high threshold voltage Vth, for example, a thin film transistor, is used.

Figure 10:
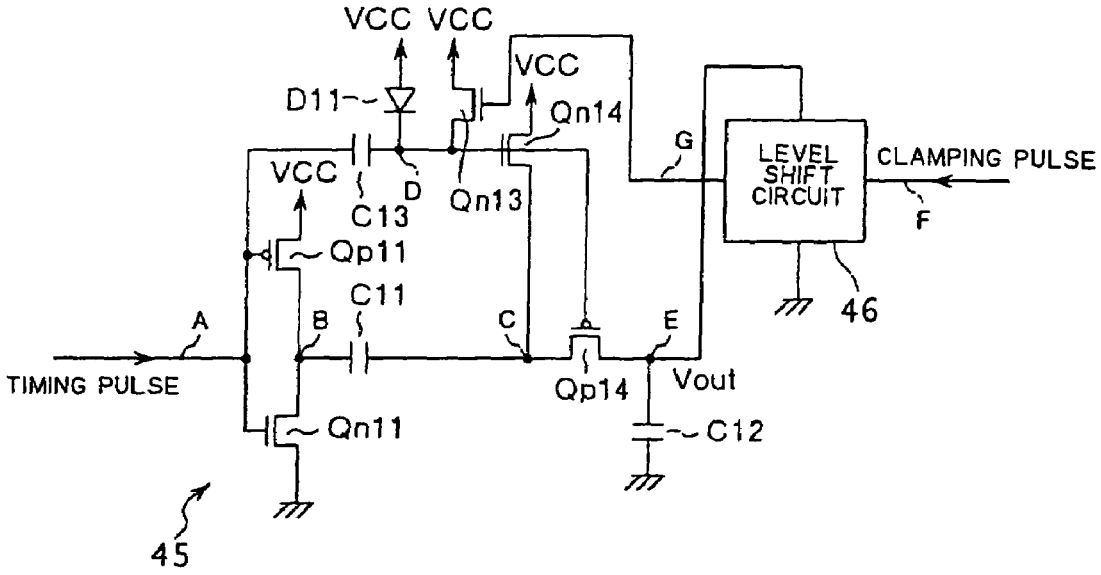
FIG. 10 is a circuit diagram showing an example of a configuration of a charge pump type D/D converter of the boost type.

A configuration of a charge pump type D/D converter of the boost type is shown in FIG. 10. Also the D/D converter of the boost type is similar in basic circuit configuration and circuit operation to the D/D converter of the negative voltage generation type.

In particular, referring to FIG. 10, the charge pump type D/D converter of the boost type is configured such that the switching transistors and the clamping transistor (MOS transistors Qp14, Qn14 and Qn13) have conduction types opposite to those of the MOS transistors Qn12, Qp12 and Qp13 of the circuit of FIG. 8 and the diode D11 is connected between the other terminal of the capacitor C11 and the power supply (VCC) and besides the level shift circuit 46 uses the output voltage Vout of the present circuit as a positive side circuit power supply and uses the ground level as a negative side circuit power supply, and is different in this regard from the configuration of the circuit of FIG. 8.

Figure 11:
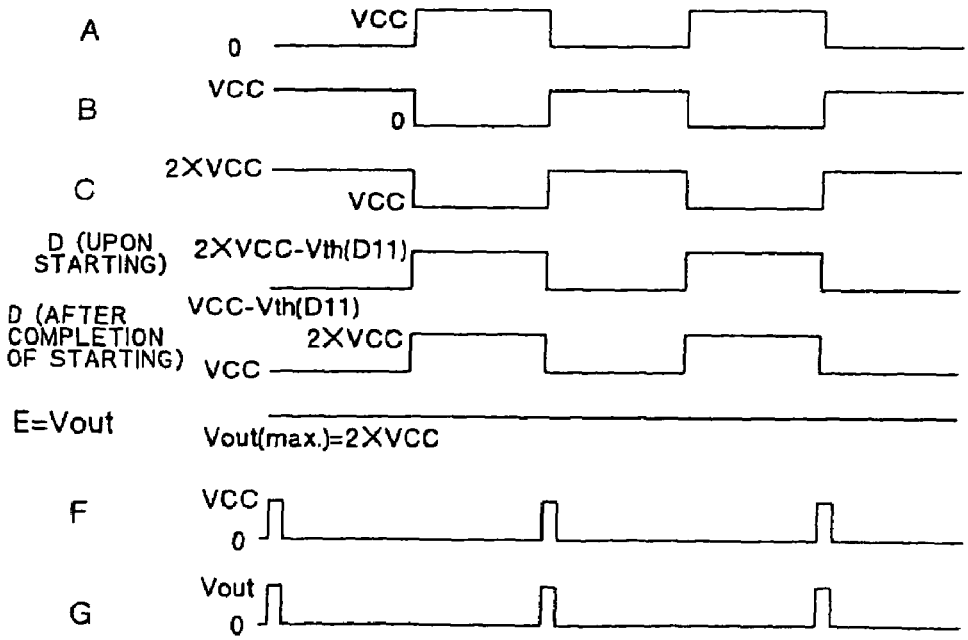
FIG. 11 is a timing chart illustrating operation of the charge pump type D/D converter of the boost type.

The charge pump type D/D converter of the boost type is basically the same as in circuit operation as the circuit of FIG. 8. The circuit operation is different only in that the switching pulse voltage (control pulse voltage) is first clamped by a diode upon starting and then clamped, after the starting process comes to an end, at the VCC level (positive side circuit power supply potential), and a voltage value 2×VCC which is twice the power supply voltage VCC is derived as the output voltage Vout. A timing chart of the signal waveforms A to G at the nodes A to G in the circuit of FIG. 10 is shown in FIG. 11.

The circuit configuration of the charge pump type D/D converter described above is a mere example, and the circuit configuration of the charge pump circuit can be modified in various forms and is not limited to the example of the circuit configuration described above.

It is to be noted that, while, in the first and second embodiments described above, the latch control pulse used by the latch circuits 27U and 27D of the H drivers 13U and 13D and the switching pulse and the clamping pulse used by the power supply circuit 16 formed from a charge pump type power supply voltage conversion circuit are taken as an example of the timing pulses generated by the timing generation circuit 15, the timing pulses generated by the timing generation circuit 15 are not limited to them.

As an example, where the V driver 14 is configured such that it includes an output enable circuit which outputs a scanning pulse when an output enable pulse is received, the output enable pulse used by the output enable circuit may be generated by the timing generation circuit 15, or where the display apparatus is configured such that it selectively takes a partial screen display mode wherein it displays information only in part of an area of the display area section thereof, which is a form of a power saving mode, a control signal (control pulse) for the partial screen display mode may be generated by the timing generation circuit 15.

Incidentally, usually two transfer clocks of the opposite phases to each other are applied to each transfer state of a shift register which forms the H drivers 13U and 13D or the V driver 14. However, where a configuration wherein two-phase transfer clocks are transmitted by two clock lines and supplied to each transfer stages of a shift register is adopted, since the two clock lines cross each other without fail while they transmit the two-phase transfer clocks to each transfer stages of the shift register, there is the possibility that the power consumption may be increased and some delay in phase may be caused by load capacitance arising from the crossing portion of the wiring lines.

Besides, in the H drivers 13U and 13D, for example, in the case of a digital interface drive circuit, since it is configured such that it includes, in addition to the shift registers 31U and 31D, sampling latch circuits 32U and 32D, the line sequencing latch circuits 33U and 33D and D/A conversion circuits 34U and 34D as described hereinabove, the two clock lines for individually transmitting the two-phase transfer clocks cross each other at many locations, and there is the possibility that the power consumption may be increased and some delay in phase may be caused by the load capacitance at the crossing locations. They appear particularly significantly with the H drivers 13U and 13D because the transfer frequency is high.

Third Embodiment

Figure 12:
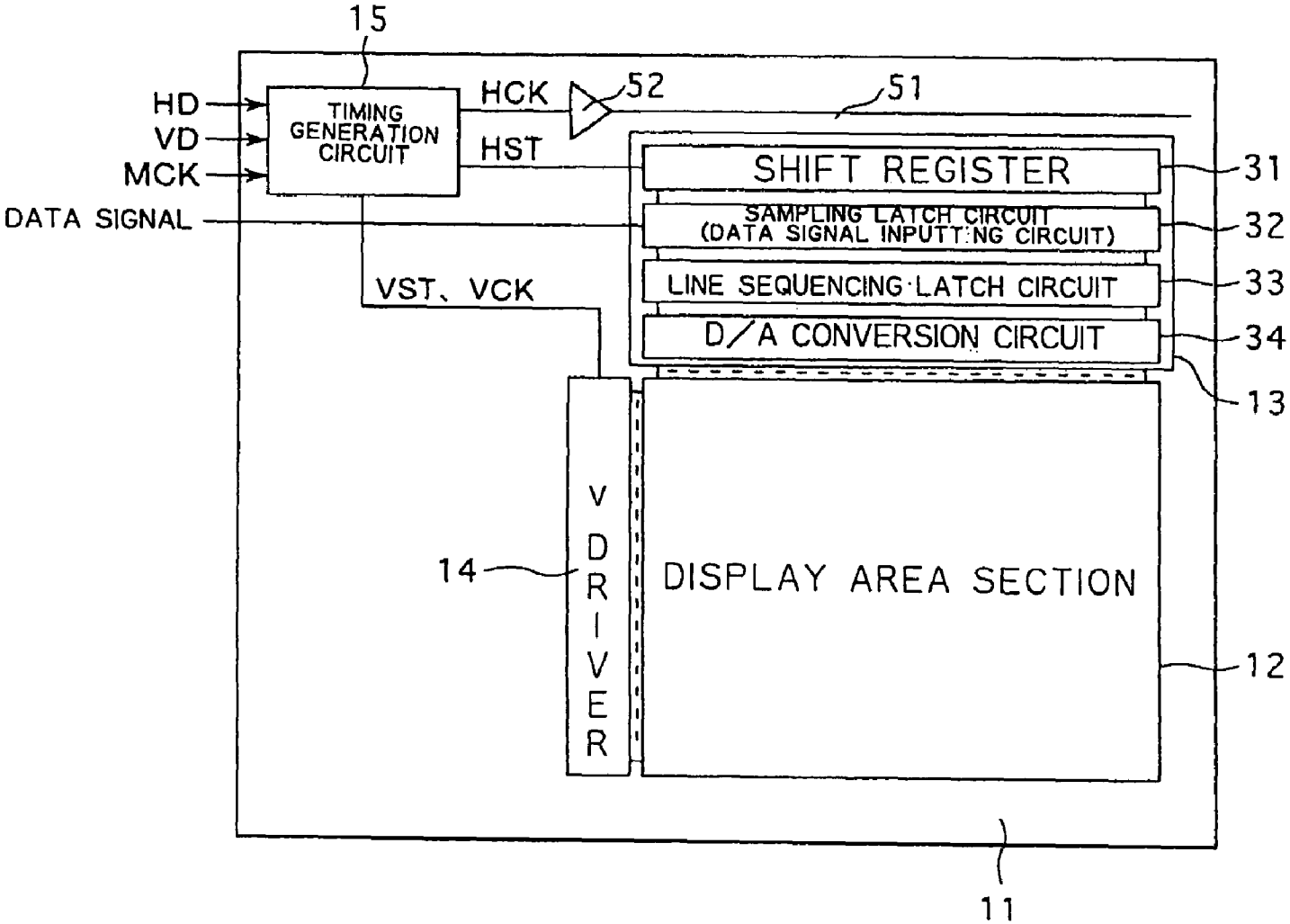
FIG. 12 is a block diagram showing an example of a configuration of a liquid crystal display apparatus of the active matrix type according to a third embodiment of the present invention and showing a case wherein an H driver is disposed only on the upper side of a display area section.

Taking this into consideration, a display apparatus according to a third embodiment described below, for example, a liquid crystal display apparatus of the active matrix type, has been configured. FIG. 12 is a block diagram showing an example of a configuration of the liquid crystal display apparatus of the active matrix type according to the third embodiment of the present invention, and in FIG. 12, like elements to those of FIG. 4 are denoted by like reference characters.

In the liquid crystal display apparatus of the active matrix type according to the present embodiment, it is premised that, in the H driver 13, a shift register 31 is disposed on the outermost side with respect to the display area section 12. Further, of various timing signals generated by the timing generation circuit 15, the horizontal transfer clock HCK is a single phase clock obtained by dividing the master clock MCK into two. Here, the master clock MCK is a clock (dot clock) of a frequency which depends upon the number of pixels (dots) of the display area section 12 in the horizontal direction.

The single phase horizontal transfer clock HCK is supplied through a buffer circuit 52 to a clock line 51 wired on the further outer side than the shift register 31 with respect to the display area section 12. The clock line 51 is wired along a transfer (shift) direction of the shift register 31 and supplies the single phase horizontal transfer clock HCK to the individual transfer stages of the shift register 31.

Where the liquid crystal display apparatus of the active matrix type is configured such that the shift register 31 is disposed on the outermost side with respect to the display area section 12 and the clock line 51 for transmitting the single phase horizontal transfer clock HCK is wired on the further outer side than the shift register 31 in this manner, the clock line 51 can be wired without intersecting with output wiring lines from the shift register 31 to the sampling latch circuit 32 in the next stage to the shift register 31. Consequently, the wiring line capacitance of the clock line 51 can be suppressed low, and therefore, the frequency of the horizontal transfer clock HCK can be increased and reduction of the power consumption can be anticipated.

Particularly since the single phase horizontal transfer clock HCK is a clock signal obtained by dividing the dot clock into two, the frequency of the horizontal transfer clock HCK is one half that of the dot clock and therefore, further reduction of the power consumption can be achieved by the reduction of the clock frequency. Further, since high speed circuit operation is possible, where it is intended to further raise the resolution, a single H driver can deal with this without the necessity for disposition of a plurality of H drivers for parallel processing, and consequently, a display unit of a high resolution can be implemented without increasing the number of terminals of an interface or without performing parallel processing.

(Particular Example of the Shift Register 31)

Figure 13:
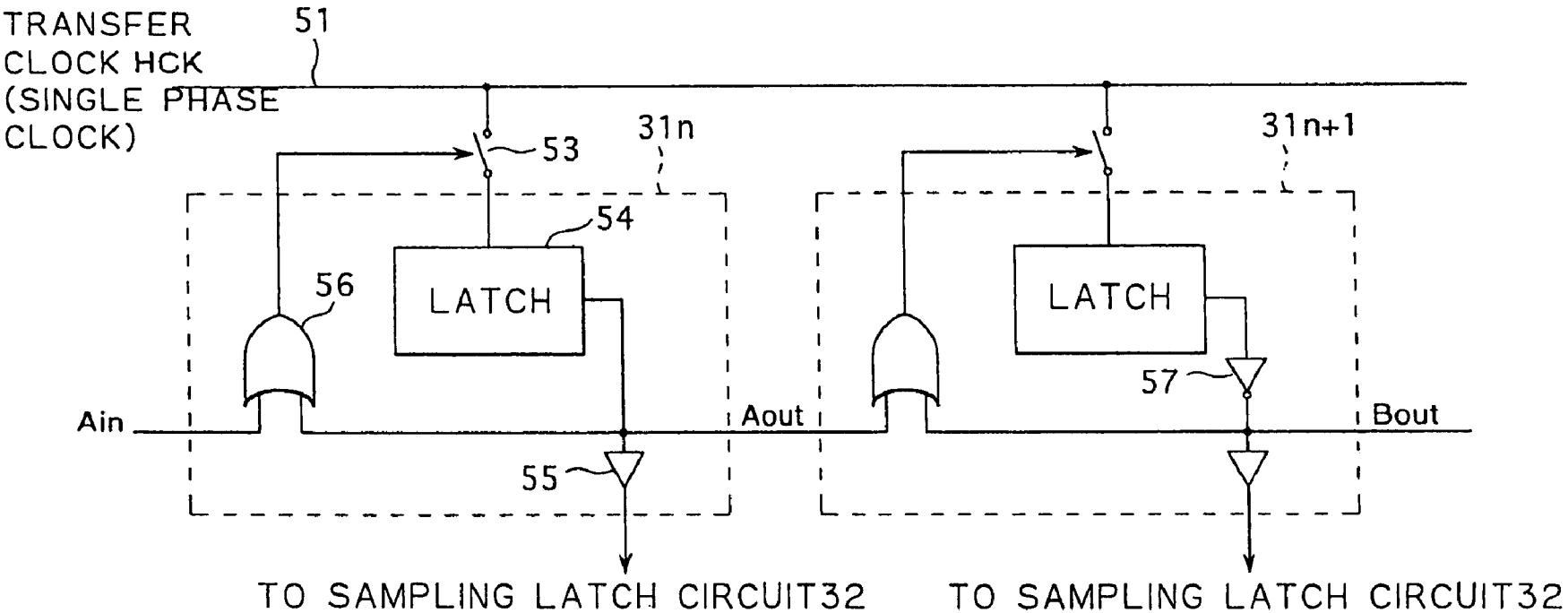
FIG. 13 is a block diagram showing an example of a particular configuration of a shift register.

FIG. 13 is a block diagram showing an example of a particular circuit configuration of the shift register 31. Here, only a transfer stage 31*n* of the nth stage and another transfer stage 31*n*+1 of the n+1th stage are shown for the simplification of the drawing. However, also the other transfer stages have the quite same configuration. Further, for description of a particular configuration, description is given taking the transfer stage 31*n* of the nth stage as an example.

Referring to FIG. 13, a switch 53 is connected between the clock line 51 and the transfer stage 31*n* of the nth stage. The switch 53 performs on (closing)/off (opening) operation under the control of a clock selection control circuit which is hereinafter described thereby to act to selectively supply the horizontal transfer clock HCK transmitted thereto by the clock line 51 to the transfer stage 31*n* of the nth stage.

The transfer stage 31*n* of the nth stage includes a latch circuit 54 for latching the horizontal transfer clock HCK selectively supplied thereto through the switch 53, a buffer circuit 55 for supplying a latch pulse of the latch circuit 54 to the sampling latch circuit 32U of the next stage, and a clock selection control circuit, for example, an OR circuit 56 for controlling the switch 53 between on and off based on a latch pulse Ain of the preceding stage and a latch pulse Aout of the self stage.

Figure 14:
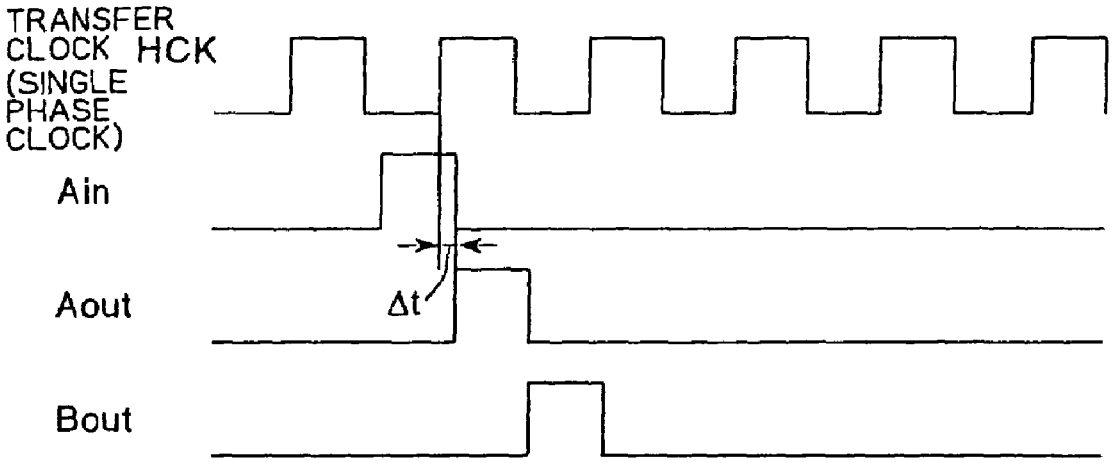
FIG. 14 is a timing chart illustrating operation of the shift register.

Now, circuit operation of the shift register 31 having the configuration described above is described with reference to a timing chart of FIG. 14.

When the latch pulse Ain is inputted from the transfer stage of the preceding stage (n−1th stage), the latch pulse Ain passes through the OR circuit 56 and is supplied to the switch 53 to cause the switch 53 to perform a switching on operation. Consequently, the horizontal transfer clock HCK transmitted by the clock line 51 is supplied to the transfer stage 31*n* of the nth stage through the switch 53 and is latched by the latch circuit 54.

After the latch pulse Ain disappears, the latch pulse Aout of the latch circuit 54 of the self stage is supplied through the OR circuit 56 to the switch 53 to keep the on state of the switch 53. Then, when also the latch pulse Aout of the self stage disappears, the switch 53 is switched into an off state. It is to be noted that, as can be seen apparently from the timing chart of FIG. 14, some delay (Δt) corresponding to a time required for the horizontal transfer clock HCK to pass through the switch 53 and the latch circuit 54 appears between the horizontal transfer clock HCK and the latch pulse Aout or Bout of each stage.

Where the switch 53 is connected between the clock line 51 for transmitting the single phase horizontal transfer clock HCK and each transfer stage of the shift register 31 and only the switch 53 in the transfer stage which requires the horizontal transfer clock HCK performs a switching on operation in this manner, since the clock line 51 is selectively connected to the individual transfer stages only when this is required, further reduction of the wiring capacitance of the clock line 51 for each transfer stage can be anticipated. As a result, higher speed circuit operation of the shift register 31 can be anticipated and further reduction of the power consumption can be anticipated.

It is to be noted that, since the transfer stage 31*n* of the nth stage latches a pulse of the positive polarity of the horizontal transfer clock HCK, the latch output of the latch circuit thereof directly makes the latch pulse Aout, but since the next transfer stage 31*n*+1 latches a pulse of the negative polarity of the horizontal transfer clock HCK, the latch pulse of the latch circuit thereof is inverted in polarity by an inverter circuit 57 to make a latch pulse Bout. Also in the present circuit example, a clock obtained by dividing the dot clock into two is used as the single phase horizontal transfer clock HCK.

Further, while the shift register in the present circuit example has been described taking the case wherein each transfer stage is formed from a latch circuit and a clock selection control circuit as an example, it is possible to form each transfer stage using a clocked inverter in place of a latch circuit. However, while a latch circuit usually has a circuit configuration wherein two inverters are connected in parallel and in the opposite directions to each other, since a clocked inverter is configured such that a switching transistor is disposed on the power supply side/ground side of the latch circuit, the former circuit configuration has an advantage that a higher speed circuit can be implemented as the number of transistors is small.

Figure 15:
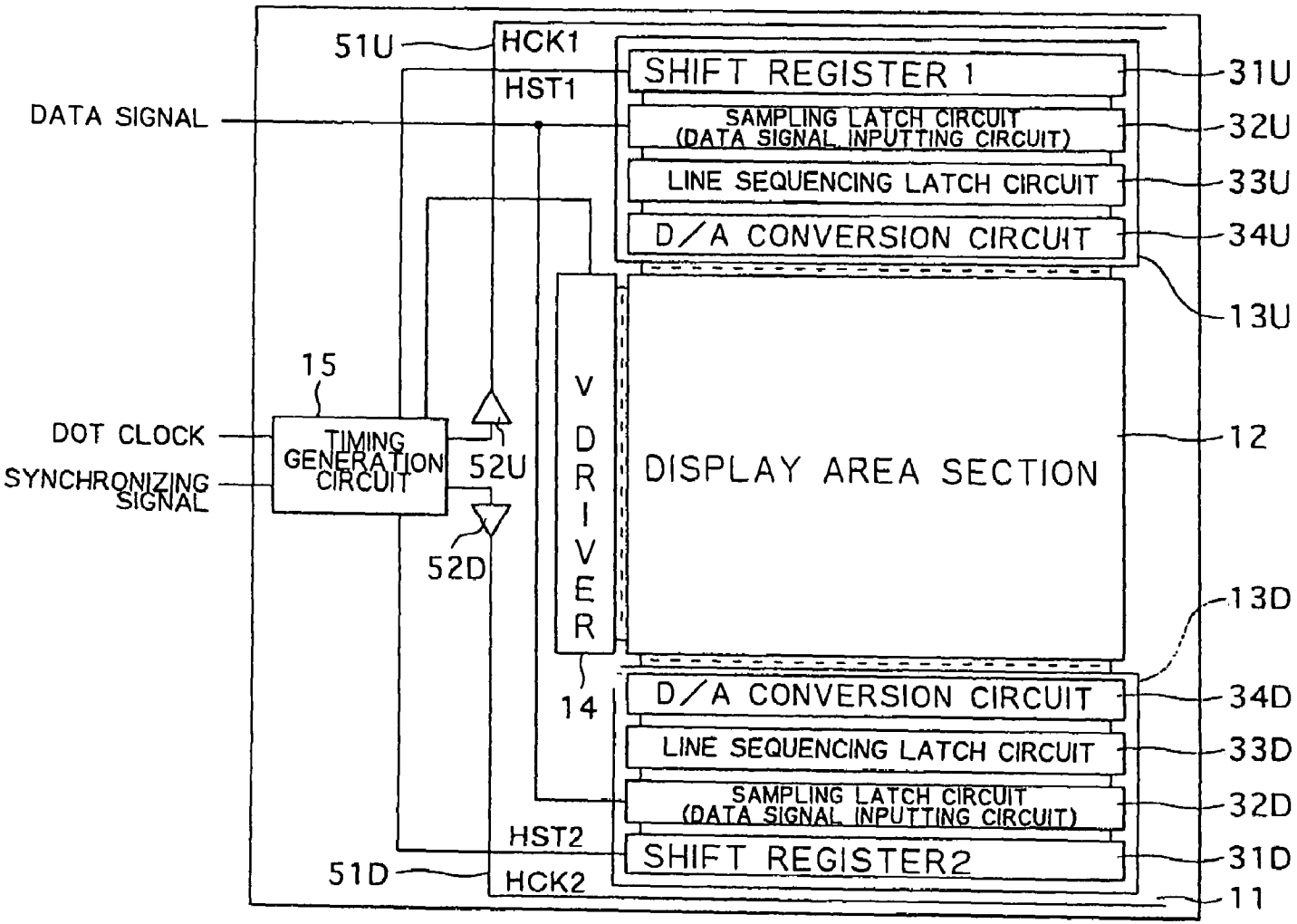
FIG. 15 is a block diagram showing an example of a configuration of the liquid crystal display apparatus of the active matrix type according to the third embodiment of the present invention and showing another case wherein an H driver is disposed on both of the upper and lower sides of the display area section.

It is to be noted that, while, in the present embodiment, description is given taking a case wherein the present invention is applied to a liquid crystal display apparatus wherein the H driver 13 is disposed only on the upper side with respect to the display area section 12 as an example, the present invention can be applied also to another liquid crystal display apparatus wherein the H drivers 13U and 13D are disposed on the upper and lower sides with respect to the display area section 12 similarly as in the first and second embodiments. An example of a configuration in this instance is shown in FIG. 15.

Where the configuration wherein the pair of upper and lower H drivers 13U and 13D are disposed with respect to the display area section 12 is taken in this manner, there is an advantage that generally the frame area can be reduced. This is because, since the frame area is required essentially, where H drivers which require an equal circuit area to each other are disposed discretely on the opposite sides, the required minimum frame areas can be utilized more effectively than where such H drivers are disposed on only one side, and consequently, the total area of the frame areas on the opposite sides can be reduced.

Further, since driving of the data lines . . . , 22*m*−2, 22*m*−1, 22*m*, 22*m*+1, of the display area section 12 can be assigned to the pair of H drivers 13U and 13D, the transfer frequency of the shift registers 31U and 31D included in the H drivers 13U and 13D can be suppressed low, which allows enlargement of the operation margin and dealing with a high resolution display unit.

Here, in the pair of H drivers 13U and 13D, the shift registers 31U and 31D are disposed on the outermost sides with respect to display area section 12 and clock lines 51U and 51D for transmitting two kinds of horizontal transfer clocks HCK1 and HCK2 are disposed on the further outer sides. The two horizontal transfer clocks HCK1 and HCK2 are both single-phase clocks, and since they are produced by dividing the dot clock into four by the timing generation circuit 15 and the H drivers 13U and 13D drive the data lines . . . , 22*m*−2, 22*m*−1, 22*m*, 22*m*+1, . . . alternately, they have a relationship that one of the clocks has a phase displaced by 90° from that of the other clock.

Figure 16:
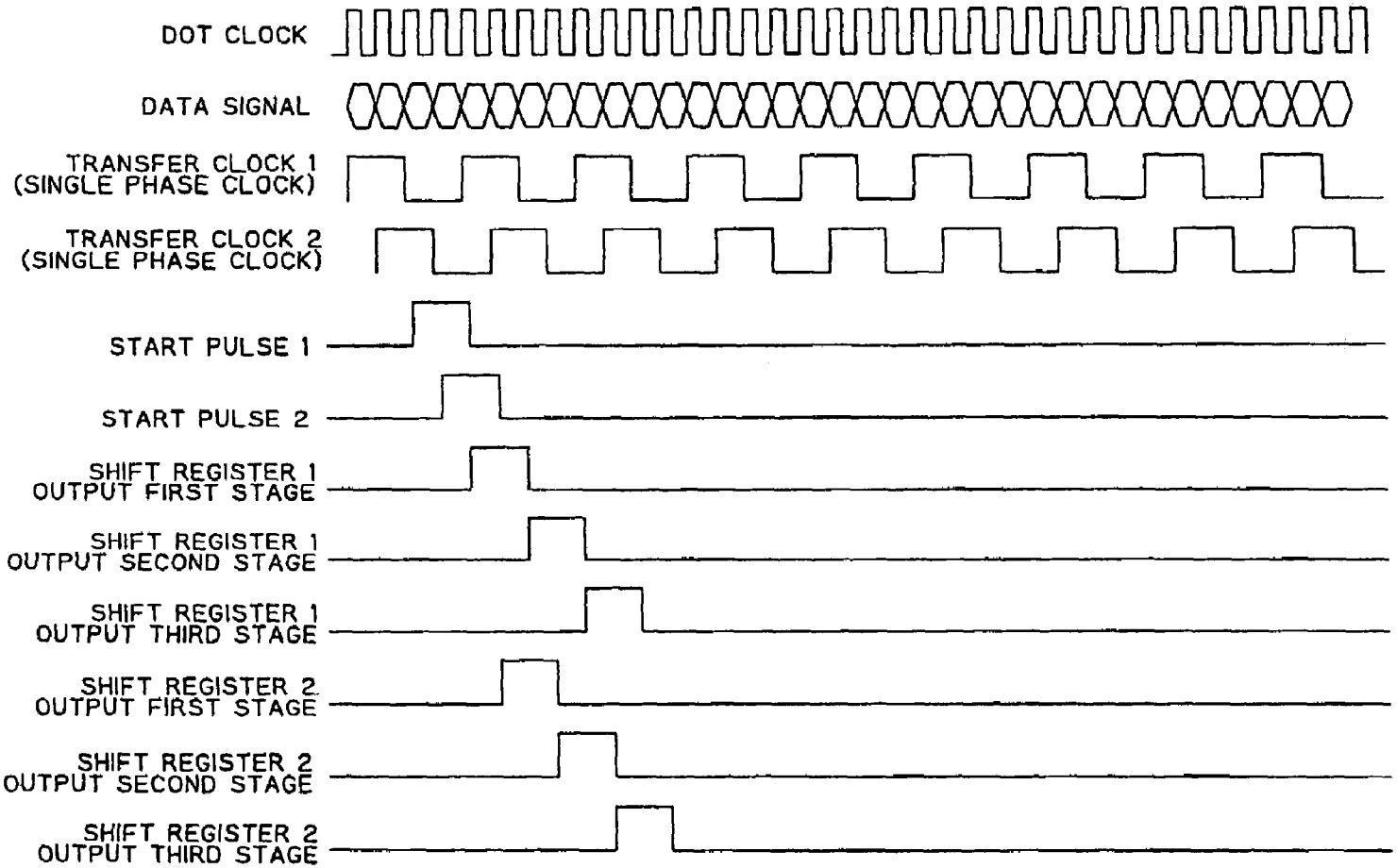
FIG. 16 is a timing chart illustrating operation of the liquid crystal display apparatus of the active matrix type according to the third embodiment.

FIG. 16 illustrates timings of the dot clock, the data signal, the two horizontal transfer clocks CHK1 and HCK2, start pulses HST1 and HST2, output pulses of the first, second and third stages of the shift register 1 (31U) and output pulses of the first, second and third stages of the shift register 2 (31D).

As described hereinabove, in the liquid crystal display apparatus of the active matrix type of the configuration wherein the H drivers 13U and 13D in a pair are disposed on the upper and lower sides of the display area section 12, where the shift registers 31U and 31D are disposed on the outermost sides with respect to the display area section 12 and the clock lines 51U and 51D for transmitting the two different horizontal transfer clocks CHK1 and HCK2 are wired on the further outer sides of the shift registers 31U and 31D, the following operation and effects are achieved. In particular, since the H drivers 13U and 13D are disposed in a pair, the transfer frequency of the shift registers 31U and 3D can be suppressed low. In addition, since the wiring capacitance of the clock lines 51U and 51D can be suppressed low as described hereinabove, increase of the frequency of the horizontal transfer clocks HCK1 and HCK2 can be anticipated and reduction of the power consumption can be anticipated.

It is to be noted that, while, in the present embodiment, description is given taking a case wherein the H drivers 13, 13U and 13U have a digital interface drive configuration formed from a shift register, a sampling latch circuit, a line sequencing latch circuit and a D/A conversion circuit as an example, the present invention can be applied similarly also where an analog interface drive configuration formed from a shift register and an analog sampling circuit is adopted.

Incidentally, as one of driving methods for a liquid crystal apparatus of the active matrix type, a common reversal driving method is known. Here, the common reversal driving method is a driving method wherein a counter-electrode voltage (common voltage) Vcom to be applied to the counter-electrode of a liquid crystal cell of each pixel commonly to the pixels is reversed for each 1H (H is a horizontal scanning period). Where the common reversal driving method is used together with, for example, a 1H reversal driving method wherein the polarity of an image signal to be applied to each pixel is reversed for each 1H, since also the polarity of the counter-electrode voltage Vcom is reversed for each 1H together with the polarity reversal of the image signal for 1H, reduction of the power supply voltage for the horizontal driving system (H drivers 13U and 13D) can be anticipated.

The counter-electrode voltage Vcom is generated by a counter-electrode voltage generation circuit 17 (refer to FIG. 1). The counter-electrode voltage generation circuit 17 is conventionally produced on a separate chip using a single crystal silicon IC or on a printed circuit board from a discrete part separately from the glass substrate 11 on which the display area section 12 is formed.

However, if the counter-electrode voltage generation circuit 17 is produced on a separate chip or a printed circuit board, then since the number of parts of the set increases and they must be formed separately from each other by different processes, this obstructs miniaturization and reduction of the cost of the set. From such a point of view as just described, the present invention adopts the configuration wherein also the counter-electrode voltage generation circuit 17 is integrated on the glass substrate 11 same as that of the display area section 12 similarly to the H drivers 13U and 13D and the V driver 14.

(Example of a Configuration of the Counter-electrode Voltage Generation Circuit)

Figure 17:
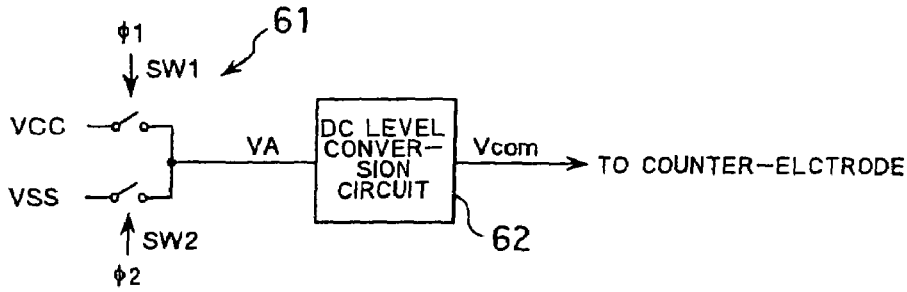
FIG. 17 is a block diagram showing an example of a particular configuration of a counter-electrode voltage generation circuit.

FIG. 17 is a block diagram showing a particular example of a configuration of the counter-electrode voltage generation circuit 17. The counter-electrode voltage generation circuit 17 according to the present example includes a switch circuit 61 for switching a positive side power supply voltage VCC and a negative side power supply voltage VSS in a fixed period to output one of them, and a DC level conversion circuit 62 for converting the DC level of an output voltage VA of the switch circuit 61 and outputting a resulting voltage as a counter-electrode voltage Vcom.

The switch circuit 61 includes a switch SW1 for receiving the positive side power supply voltage VCC as an input thereto, and another switch SW2 for receiving the negative side power supply voltage VSS as an input thereto. The switches SW1 and SW2 are switched with control pulses $\phi 1$ and $\phi 2$ having the opposite phases to each other so that the positive side power supply voltage VCC and the negative side power supply voltage VSS are outputted alternately in a fixed period, for example, in a 1H period. Consequently, the voltage VA of the amplitude VSS or VCC is outputted from the switch circuit 61.

Figure 18:
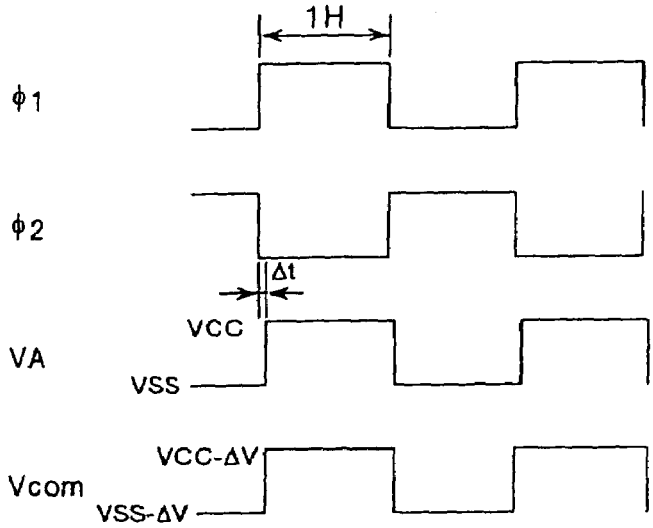
FIG. 18 is a timing chart illustrating operation of the counter-electrode voltage generation circuit.

The DC level conversion circuit 62 level-converts the output voltage VA of the amplitude VSS or VCC of the switch circuit 61 to a DC voltage of, for example, the amplitude VSS−ΔV or VCC−ΔV and outputs the DC voltage as the counter-electrode voltage Vcom. The counter-electrode voltage Vcom whose polarity reverses in a 1H period is supplied to the common line 27 of FIG. 2 to effect common reversal driving. FIG. 18 illustrates timings of the control pulses $\phi 1$ and $\phi 2$, output voltage VA and counter-electrode voltage Vcom. It is to be noted that some delay (Δt) appears between the control pulses $\phi 1$ and $\phi 2$ and the output voltage VA.

Figure 19:
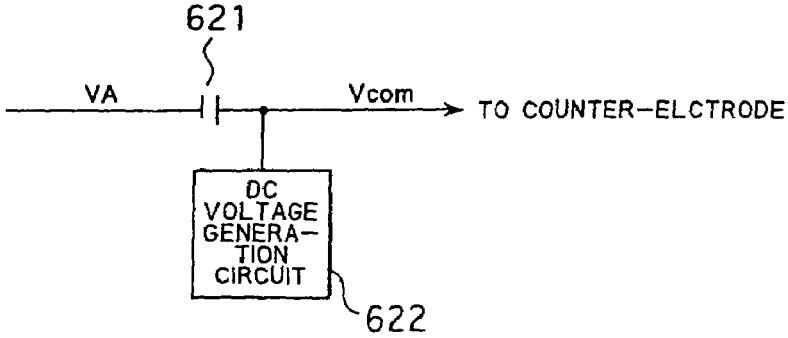
FIG. 19 is a block diagram showing an example of a configuration of a DC level conversion circuit.

The DC level conversion circuit 62 may be formed in various circuit configurations. A particular example of a configuration of them is shown in FIG. 19. The DC level conversion circuit 62 according to the present example has a simple configuration including a capacitor 621 for cutting a DC component of the voltage VA supplied from the switch circuit 61, and a DC voltage generation circuit 622 for generating a predetermined DC voltage to be provided to the voltage VA having passed through the capacitor 621.

Where the counter-electrode voltage generation circuit 17 including the DC level conversion circuit 61 which uses the capacitor 621 is integrated on the same glass substrate 11 as that of the display area section 12 as described above, since the capacitor 621 requires a great area, it is in most cases advantageous if the capacitor 621 is not integrated with the display area section 12 but is produced as a discrete part. Accordingly, only the capacitor 621 should be produced outside the glass substrate 11 while the remaining circuit elements, that is, the switch circuit 61 and the DC voltage generation circuit 622, are formed integrally on the same glass substrate 11 as that of the display area section 12.

In this instance, since the TFT is used for the pixel transistors of the display area section 12, the TFT should be used also for the transistor which composes the switch circuit 61 of the counter-electrode voltage generation circuit 17. Since it has become easy to integrate a TFT thanks to improvement of the performance and reduction of the power consumption in recent years, if the counter-electrode voltage generation circuit 17, particularly at least the transistor circuitry of the counter-electrode voltage generation circuit 17, is produced using the same process on the glass substrate 11 together with the display area section 12, then reduction of the cost by simplification of the production process and reduction in thickness and compaction by integration can be anticipated.

Figure 20:
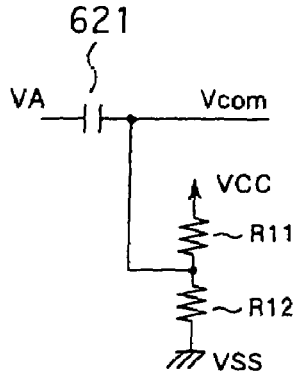
FIG. 20 is a circuit diagram showing a first example of a particular configuration of a DC voltage generation circuit.
Figure 21:
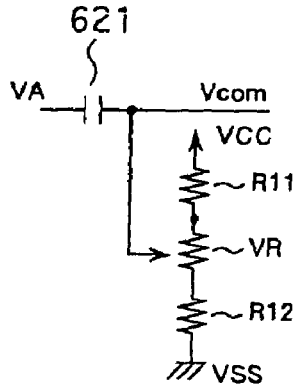
FIG. 21 is a circuit diagram showing a second example of a particular configuration of the DC voltage generation circuit.
Figure 22:
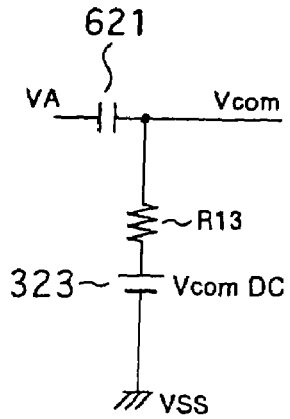
FIG. 22 is a circuit diagram showing a third example of a particular configuration of the DC voltage generation circuit.

Five particular circuit examples of the DC voltage generation circuit 622 are shown in FIGS. 20 to 24. The circuit example shown in FIG. 20 is configured such that dividing resistors R11 and R12 connected in series between a positive side power supply VCC and a negative side power supply VSS (in the present example, the ground) are used to obtain a divisional voltage at a node between them and the divisional voltage is used as the DC level. The circuit example shown in FIG. 21 is configured such that a variable resistor VR is connected between dividing resistors R11 and R12 so that the DC level can be adjusted by the variable resistor VR. The circuit example shown in FIG. 22 is configured such that it includes a resistor R13 and a DC power supply source 623 and uses a voltage which depends upon the DC power supply source 623 as the DC level. If the DC power supply source 623 is formed as a variable voltage source, then the DC level can be adjusted.

Figure 23:
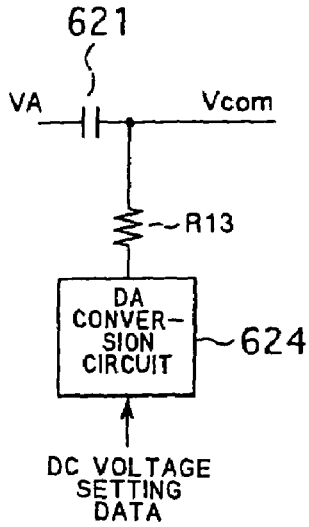
FIG. 23 is a circuit diagram showing a fourth example of a particular configuration of the DC voltage generation circuit.
Figure 24:
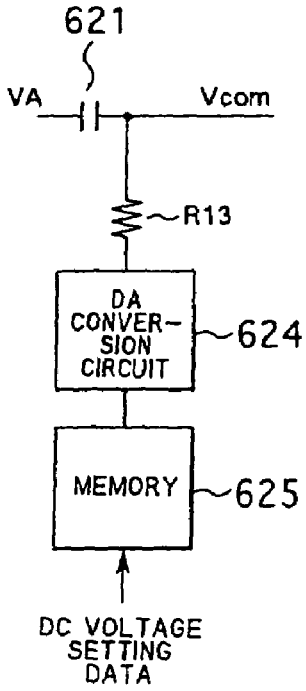
FIG. 24 is a circuit diagram showing a fifth example of a particular configuration of the DC voltage generation circuit.

The circuit example shown in FIG. 23 is configured such that it uses a D/A conversion circuit 624 in place of the DC power supply source 623 of FIG. 22. In the case of the present circuit example, digital DC voltage setting data is inputted to the D/A conversion circuit 624 to determine the DC level. Consequently, the DC level can be adjusted using a digital signal. The circuit example shown in FIG. 24 is configured such that it includes a memory 625 for storing DC voltage setting data in addition to the configuration of FIG. 23. With the circuit configuration, even if the DC voltage setting data is not inputted repetitively, the DC level can be determined.

In the counter-electrode voltage generation circuit 17 described above, where a reference voltage selection type D/A conversion circuit is used for the D/A conversion circuits 34U and 34D of the H drivers 13U and 13D, it is possible to apply the output voltage VA or the counter-electrode voltage Vcom itself generated by the counter-electrode voltage generation circuit 17 as one of reference voltages, that is, a reference voltage for a white signal or a black signal.

(Example of a Configuration of the Reference Voltage Selection Type D/A Conversion Circuit)

Figure 25:
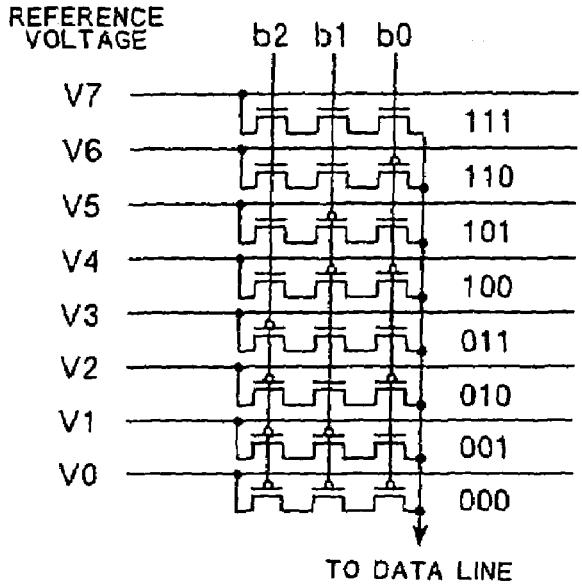
FIG. 25 is a circuit diagram showing an example of a configuration of a unit circuit of a reference voltage selection type D/A converter circuit.

Subsequently, the reference voltage selection type D/A conversion circuits 28U and 28D are described. FIG. 25 is a circuit diagram showing an example of a configuration of a unit circuit of the reference voltage selection type D/A conversion circuits 28U and 28D. Here, the configuration is shown.taking a case wherein digital image data inputted is, for example, 3-bit (b2, b1, b0) data as an example, and 8 ($=2^3$) reference voltages V0 to V7 are prepared for the image data of 3 bits. The unit circuit is disposed on by one for each of the data lines . . . , 22*m*−2, 22*m*−1, 22*m*, 22*m*+1, . . . of the display area section 12.

Figure 26:
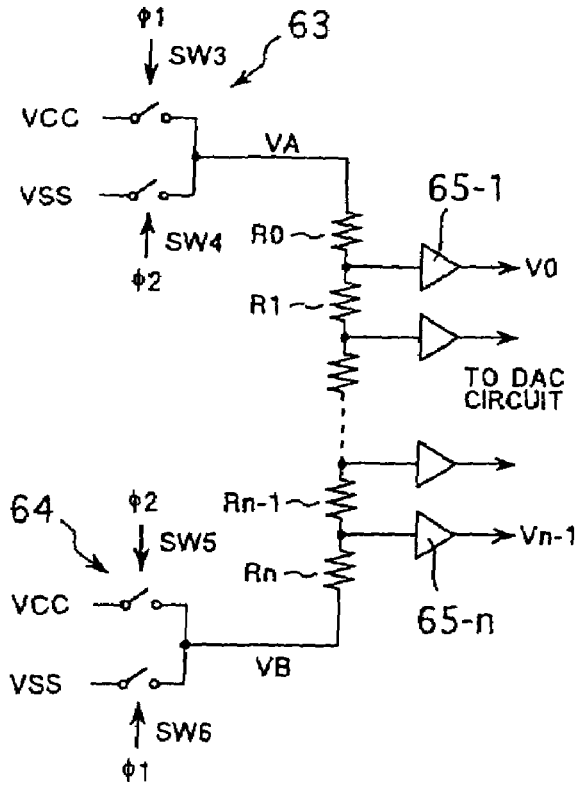
FIG. 26 is a circuit diagram showing an example of a common configuration of a reference voltage generation circuit.

An example of a common configuration of a reference voltage generation circuit for generating such reference voltages V0 to V7 is shown in FIG. 26. The reference voltage generation circuit according to the present configuration example includes two switch circuits 63 and 64 for switching the positive side power supply voltage VCC and the negative side power supply voltage VSS with the opposite phases to each other in a fixed period, and n+1 resistors R0 to Rn connected in series between output terminals of the switch circuits 63 and 64. The reference voltage generation circuit thus divides the voltage VCC−VSS by means of the resistors R0 to Rn such that n reference voltages V0 to Vn-1 are derived from common nodes between the resistors and outputted through buffer circuits 65-1 to 65-n.

In the reference voltage generation circuit having the configuration described above, the buffer circuits 65-1 to 65-n have an impedance conversion function. They act to prevent a dispersion in writing characteristic from appearing between the upper and lower H drivers 13U and 13D even if, where the present reference voltage generation circuit is formed in a substrate separate from the glass substrate 11 such that a reference voltage is transmitted to the D/A conversion circuit on the glass substrate 11, the wiring line impedance becomes high because the wiring line lengths from the reference voltage generation circuit to the D/A conversion circuits 34U and 34D become long.

Figure 27:
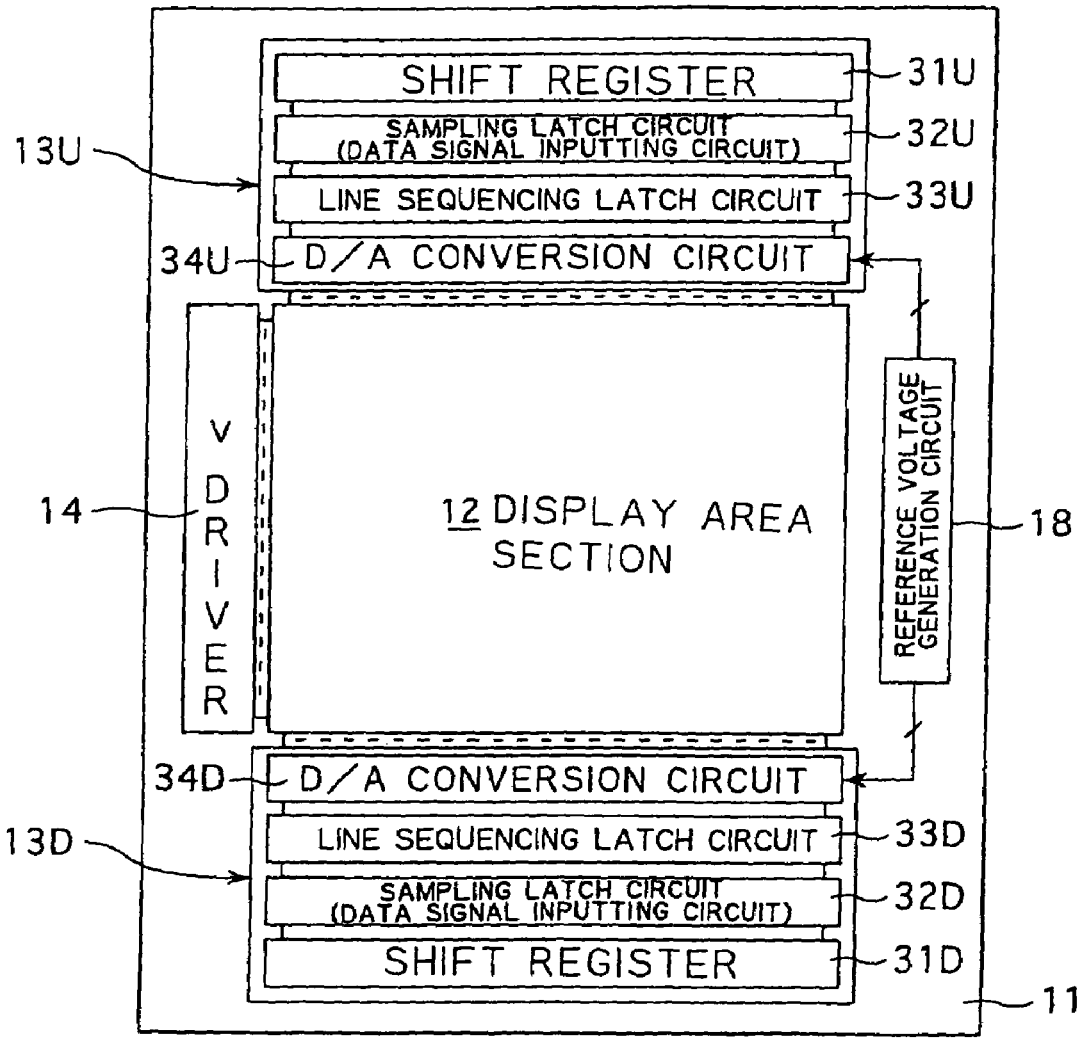
FIG. 27 is a block diagram showing an example of disposition of the reference voltage generation circuit.

On the other hand, on the liquid crystal display apparatus of the active matrix type according to the present embodiment, since the reference voltage generation circuit 18 is integrated on the same glass substrate 11 together with the H drivers 13U and 13D, the wiring line lengths between the reference voltage generation circuit 18 and the H drivers 13U and 13D can be set very short. Particularly, as shown in FIG. 27, upon integration of the reference voltage generation circuit 18, where the reference voltage generation circuit 18 is disposed at a substantially middle position of the display area section 12 in the vertical direction, that is, at a position at a substantially equal distance from the upper and lower H drivers 13U and 13D, the wiring line lengths to the H drivers 13U and 13D can be set substantially equal to each other.

Figure 28:
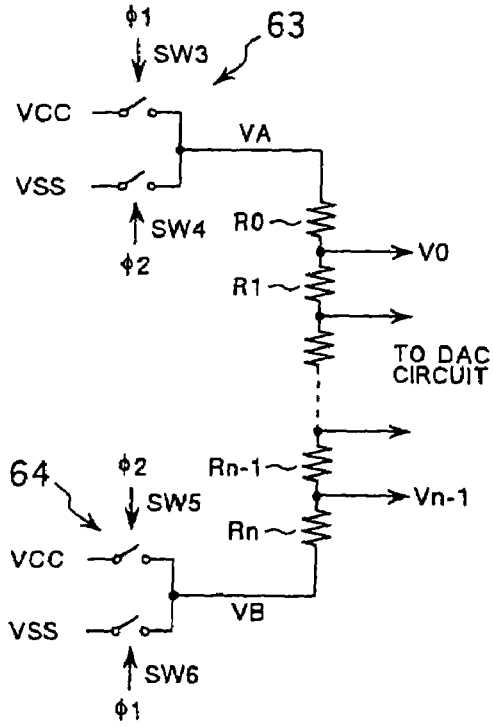
FIG. 28 is a circuit diagram showing an example of a particular configuration of the reference voltage generation circuit.

Consequently, when the reference voltage generation circuit 18 is configured, the buffer circuits 65-1 to 65-n used in the common circuit example shown in FIG. 26 are not required as seen from a circuit diagram of FIG. 28. In particular, as apparently seen from the circuit configuration shown in FIG. 28, n reference voltages V0 to V*n*−1 derived from common nodes of resistors R0 to Rn can be supplied directly to the upper and lower H drivers 13U and 13D. As a result, the circuit configuration of the reference voltage generation circuit 18 can be simplified as the buffer circuits 65-1 to 65-n can be omitted.

Figure 29:
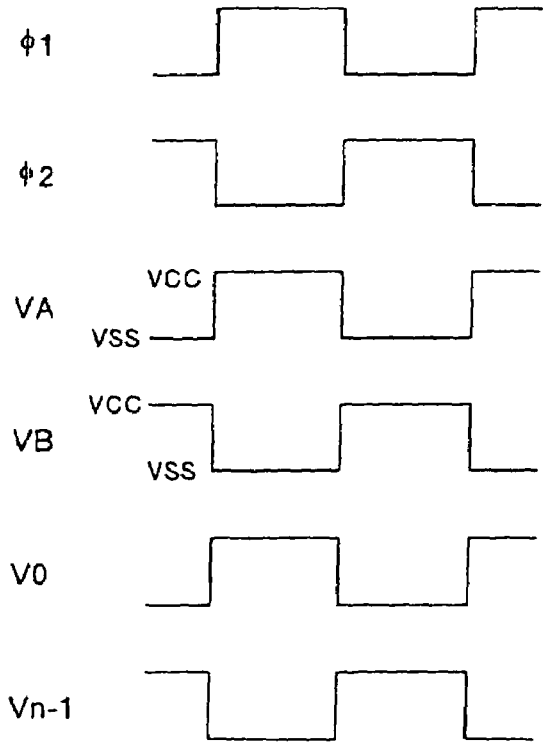
FIG. 29 is a timing chart illustrating operation of the reference voltage generation circuit.

It is to be noted that, in FIG. 28, like elements to those in FIG. 26 are denoted by like reference characters. Further, in FIG. 28, switches SW3 to SW6 which form the switch circuits 63 and 64 are formed from, for example, a transistor. In FIG. 29, waveforms of the control pulses $\phi 1$ and $\phi 2$, upper and lower limit voltages VA and VB and reference voltages V0 and V*n*−1 are illustrated.

In the switch circuits 63 and 64, the switches SW3 and SW6 are switched with the control pulse $\phi 1$ and the switches SW4 and SW5 are switched with the control pulse $\phi 2$ having the opposite phase to that of the control pulse $\phi 1$. The reason why the positive side power supply voltage VCC and the negative side power supply voltage VSS are switched with the opposite phases to each other in a fixed period, for example, in a 1H period, in this manner is that it is intended to AC drive (in the present example, 1H reversal drive) the liquid crystal in order to prevent deterioration of the liquid crystal.

Further, upon integration of the reference voltage generation circuit 18, since a TFT is used for the pixel transistors of the display area section 12, if a TFT is used also for the transistors which form the switch circuits 63 and 64 of the reference voltage generation circuit 18 and at least the transistor circuits of the same are produced on the glass substrate 11 together with the display area section 12, then the reference voltage generation circuit 18 can be produced readily and besides at a low cost. Besides, where the reference voltage generation circuit 18, particularly at least the transistor circuits of the reference voltage generation circuit 18, are formed integrally on the same glass substrate 11 by the same process using a TFT same as that used for the pixel transistors of the display area section 12, reduction of the cost by simplification of the production process and besides reduction in thickness and compaction by integration can be achieved.

In the reference voltage generation circuit of the configuration described above, the output voltage VA of the switch circuit 63 is used as it is as the reference voltage V7 for a white signal in the normally white condition, and the output voltage VB of the switch circuit 64 is used as it is as the reference voltage V0 for a black signal in the normally white condition. Further, if the difference voltage between the reference voltage V0 for a black signal and the reference voltage V7 for a white signal is divided by means of the dividing resistors R1 to R7, then the reference voltages V1 to V6 for half tones are produced. For the normally black condition, the output voltage VA is used as the reference voltage V7 for a black signal while the output voltage VB is used as the reference voltage V0 for a white signal.

Figure 30:
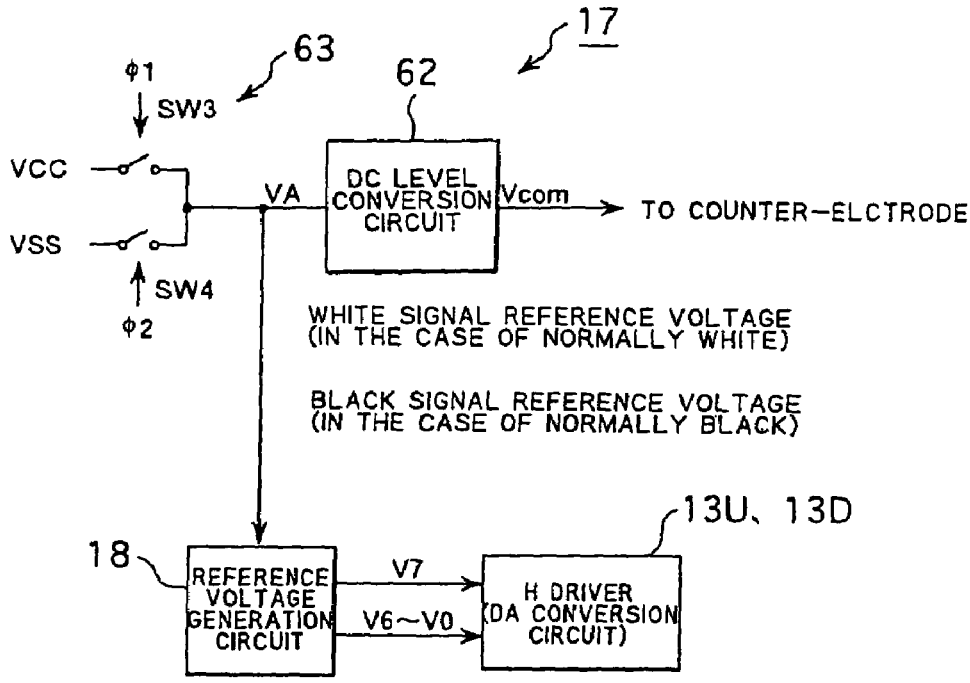
FIG. 30 is a block diagram showing an example of application of the counter-electrode voltage generation circuit.

In the liquid crystal display apparatus of the active matrix type wherein a reference voltage selection type D/A conversion circuit including a reference voltage generation circuit having the configuration described above is used for the D/A conversion circuits 34U and 34D of the H drivers 13U and 13D, the output voltage VA generated by the counter-electrode voltage generation circuit 17 can be used as one of the reference voltages to be applied from the reference voltage generation circuit 18 to the D/A conversion circuits 34U and 34D as shown in FIG. 30.

More particularly, as described hereinabove, the reference voltage for a white signal for the normally white condition (or the reference voltage for a black signal for the normally black condition) to be used by the reference voltage selection type D/A conversion circuit is a voltage obtained by switching the positive power supply voltage VCC and the negative side power supply voltage VSS in a fixed period. In the counter-electrode voltage generation circuit 17, the output voltage VA is obtained by switching the positive side power supply voltage VCC and the negative side power supply voltage VSS in the same period and with the same phase and can be used as the reference voltage for a white signal (or the reference voltage for a black signal).

Where the output voltage VA generated by the counter-electrode voltage generation circuit 17 is used as one of the reference voltages to be applied from the reference voltage generation circuit 18 to the D/A conversion circuits 34U and 34D in this manner, since some of the functions of the reference voltage generation circuit 18 can be substituted by the counter-electrode voltage generation circuit 17, the switch circuit 63 of the reference voltage generation circuit shown in FIG. 28 can be omitted. Accordingly, since the circuit scale can be reduced as much, further miniaturization and reduction in cost of the present liquid crystal display apparatus can be anticipated. While it is described that, in the present example, the output voltage VA is used as the reference voltage for a white signal (or the reference signal for a black signal), it is also possible to use the counter-electrode voltage Vcom itself as such.

Incidentally, in the display apparatus of the active matrix type wherein a polycrystalline silicon TFT is used as a switching element for a pixel, there is a tendency that a driving circuit which uses a polycrystalline silicon TFT is formed integrally on the glass substrate 11 same as that of the display area section 12 as described hereinabove. The display apparatus of the active matrix type wherein a driving circuit which uses a polycrystalline silicon TFT is formed integrally in this manner is very promising as a technique which allows miniaturization, high definition and high reliability. Since the polycrystalline silicon TFT has a mobility higher by two digits when compared with the amorphous silicon TFT, it allows integral formation of the driving circuit on the same substrate as that of the display area section.

Meanwhile, since the polycrystalline silicon TFT is, when compared with the single crystal silicon transistor, lower in mobility, higher in threshold voltage Vth and greater in dispersion of the threshold voltage Vth, it has a problem that it cannot be used to form a circuit which operates at a high speed or a circuit which uses a low voltage. Since a great variation of the threshold voltage Vth makes it difficult particularly to form a differential circuit for which a pair of transistors having same characteristics are required, it makes a very significant problem to circuit design.

The dispersion of the threshold voltage Vth is related to the fact that the back gate potential of the TFT is the high impedance. In particular, since a conventional TFT has one of the bottom gate structure and the top gate structure as a gate structure thereof, the back gate of the transistor exhibits a high impedance and makes the dispersion of the threshold voltage Vth great. Accordingly, it is very difficult to use the TFT having such a characteristic as just described to produce a low voltage circuit or a small signal amplitude circuit.

Figure 31:
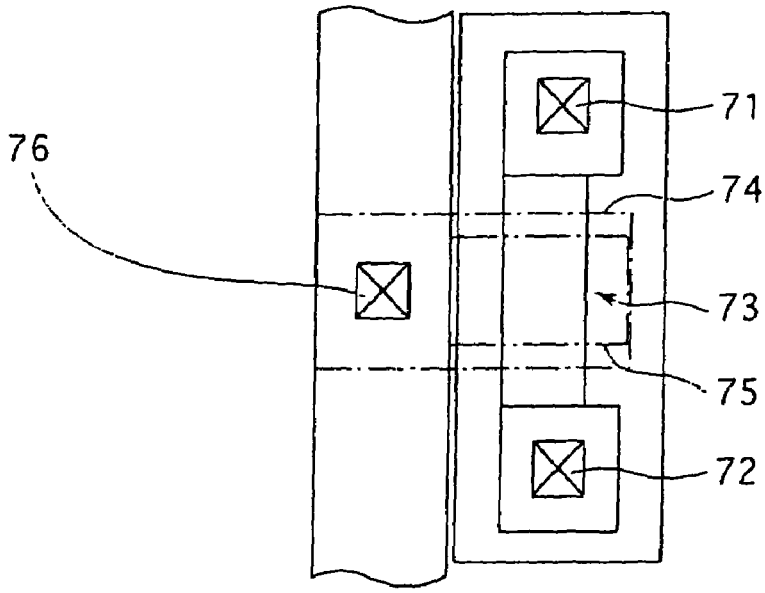
FIG. 31 is a view of a plane pattern of a TFT having a dual gate structure.

Meanwhile, a structure wherein a gate electrode is provided also on the back gate side of a transistor and is connected to the front side gate electrode, that is, a structure wherein, as shown in FIG. 31, a pair of gate electrodes, that is, a front gate electrode 74 and a back gate electrode 75 are disposed on the opposite sides of a channel area 73 between a source area 71 and a drain area 72 and are connected to each other by a contact portion 76 (the structure described is hereinafter referred to as dual gate structure), has been proposed. The TFT of the dual gate structure has an advantage that the dispersion of the threshold voltage Vth can be suppressed small.

However, with the TFT of the dual gate structure, since it is necessary to provide a contact area including the contact portion 76 for connecting the pair of gate electrodes 74 and 75 to each other as apparently seen from FIG. 31, the area required for configuration of a device is great. Accordingly, where the TFT of the dual gate structure is used to produce a driving circuit, a very great circuit area is required, and as a result, the frame of the display apparatus (peripheral area of the display area section 12) becomes great.

Here, in the display apparatus shown in FIG. 1, the H drivers 13U and 13D, V driver 14 and timing generation circuit 15 are circuits which handle a signal of a small amplitude. It is to be noted that, though not shown in FIG. 1, a clock I/F circuit and a synchronizing signal I/F circuit for fetching the master clock MCK, horizontal synchronizing signal HD and vertical synchronizing signal VD supplied from the outside of the substrate are provided at the input stage of the timing generation circuit 15. Also the I/F circuits are circuits which handle a signal of a small amplitude. Further, also a CPU I/F circuit and so forth are listed as circuits which handle a signal of a small amplitude. Such circuits which handle a signal of a small amplitude as mentioned above are circuits with which it is desired to minimize the dispersion of the threshold voltage Vth of a transistor.

On the other hand, the power supply circuit 16, counter-electrode voltage generation circuit 17 and reference voltage generation circuit 18 are circuits which handle a power supply voltage. Such circuits which handle a power supply voltage as just mentioned are circuits with which it is desired to raise the current capacity of a transistor as high as possible.

Thus, in the liquid crystal display apparatus of the active matrix type according to the present embodiment, at least one of those circuits which handle a signal of a small amplitude or those circuits which handle a power supply voltage, or some of the circuits which handle a signal of a small amplitude or some of the circuits which handle a power supply voltage are produced using a TFT of the dual gate structure while the other circuits are produced using a TFT of the top gate structure or the bottom gate structure.

Since the TFT of the dual gate structure has a superior characteristic that the dispersion of the threshold voltage Vth is small, a transistor circuit formed using the dual gate TFT has augmented reliability, and therefore, the TFT of the dual gate structure is useful where it is used to produce a circuit which handles a signal of a small amplitude, particularly a circuit wherein transistors operate in a pair, that is, which includes a pair of transistors having substantially same characteristics, such as, for example, a differential circuit or a current mirror circuit.

However, a TFT of the dual gate structure requires provision of a contact area for connecting the front gate electrode and the back gate electrode to each other and requires a great area to form the element. Therefore, if the dual gate TFT is used to produce all circuits, then the circuit scale becomes very great. Accordingly, of circuits which handle a signal of a small amplitude, a minimum number of necessary circuits such as a circuit which includes transistors which operate in a pair are produced using the dual gate TFT while the other circuits are produced using a TFT of the top gate structure or the bottom gate structure whose required area is small. This makes it possible to form circuits whose dispersion of the threshold voltage Vth is small and which have a high degree of reliability without making the circuit scale great.

Further, since the TFT of the dual gate structure is equivalent to a transistor formed with a greater size although it has a smaller area in plane and has an advantage that it has a high current capacity, where the dual gate TFT is used to produce a circuit which handles a power supply voltage, the current capacity of the circuit can be raised. However, similarly to the case described above, if the dual gate TFT is used to produce all circuits, then since the circuit scale becomes very great, a necessary minimum number of circuits are produced using the dual gate TFT while the other circuits are produced using a TFT of the top gate structure or the bottom gate structure. Consequently, a circuit having a high current capacity can be formed without making the circuit scale great.

Figure 32:
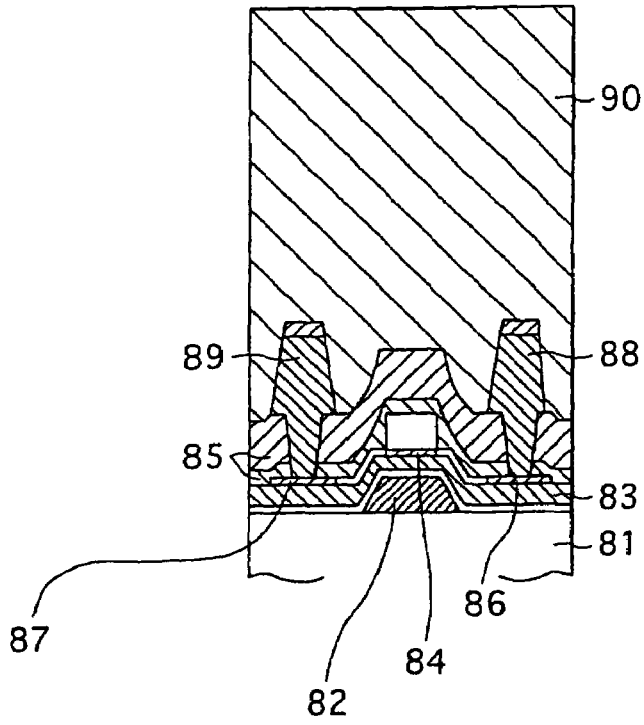
FIG. 32 is a view of a sectional structure of a TFT having a bottom gate structure.

Here, particular structures of a TFT of the bottom gate structure, a TFT of the top gate structure and a TFT of the dual gate structure are described with reference to FIGS. 32 to 34. FIG. 32 shows a sectional structure of a TFT of the bottom gate structure, FIG. 33 shows a sectional structure of a TFT of the top gate structure, and FIG. 34 shows a sectional structure of a TFT of the dual gate structure.

First, in the TFT of the bottom gate structure, as shown in FIG. 32, a gate electrode 82 is formed on a glass substrate 81 and a channel area (polycrystalline silicon layer) 84 is formed on the gate electrode 82 with a gate insulating film 83 interposed therebetween, and an interlayer insulating film 85 is formed on the channel area 84. A source area 86 and a drain area 87 are formed on the gate insulating film 83 sidewardly of the gate electrode 82, and a source electrode 88 and a drain electrode 89 are connected to the areas 86 and 87, respectively, with the interlayer insulating film 85 interposed therebetween. Further, an insulating film 90 is formed on the source electrode 88 and the drain electrode 89.

Figure 33:
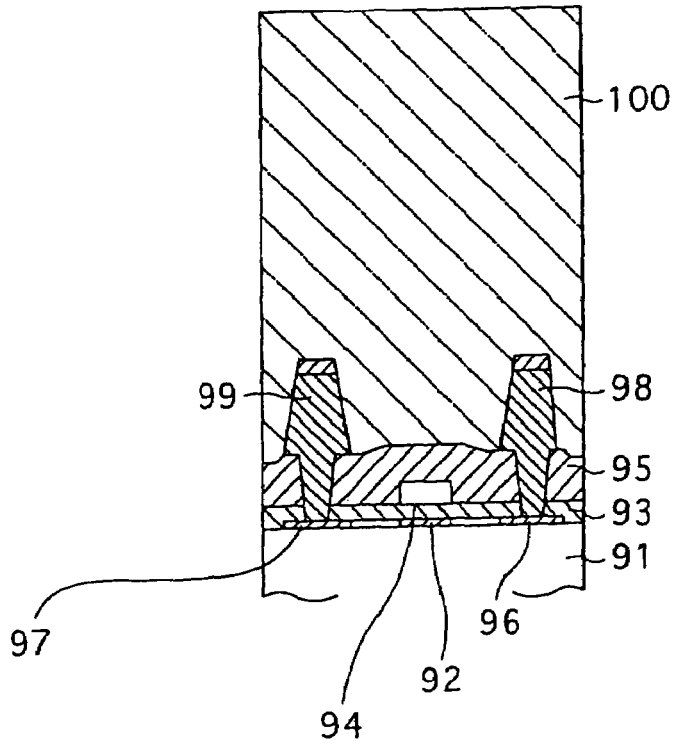
FIG. 33 is a view of a sectional structure of a TFT having a top gate structure.

Meanwhile, in the TFT of the top gate structure, as shown in FIG. 33, a channel area (polycrystalline silicon layer) 92 is formed on a glass substrate 91 and a gate electrode 94 is formed on the channel area 92 with a gate insulating film 93 interposed therebetween, and an interlayer insulating film 95 is formed on the gate electrode 94. Further, a source area 96 and a drain area 97 are formed on the glass substrate 91 sidewardly of the channel area 92, and a source electrode 98 and a drain electrode 99 are formed in the areas 96 and 97, respectively, with the interlayer insulating film 95 interposed therebetween. Further, an insulating film 100 is formed on the source electrode 98 and the drain electrode 99.

Figure 34:
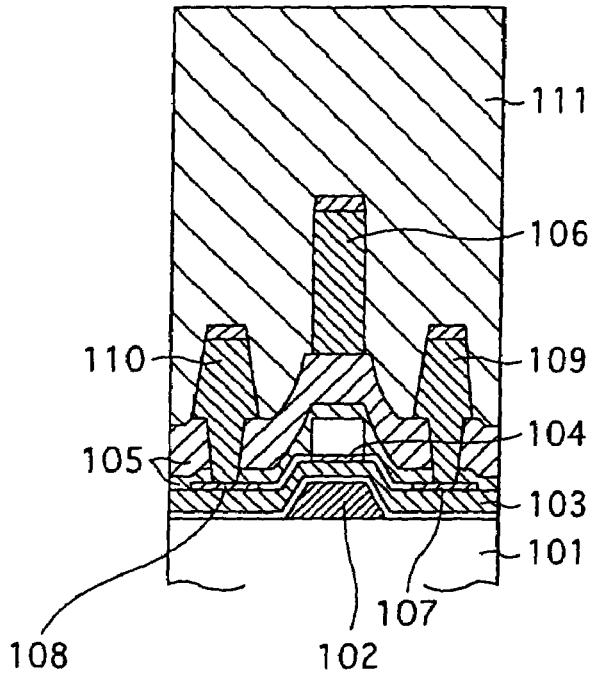
FIG. 34 is a view of a sectional structure of a TFT having a dual gate structure.

Finally, in the TFT of the dual gate structure, as shown in FIG. 34, a front gate electrode 102 is formed on a glass substrate 101 and a channel area (polycrystalline silicon layer) 104 is formed on the front gate electrode 102 with a gate insulating film 103 interposed therebetween, and an interlayer insulating film 105 is formed on the channel area 104. Further, a back gate electrode 106 is formed on the front gate electrode 102 with the channel area 104 and the interlayer insulating film 105 interposed therebetween. A source area 107 and a drain area 108 are formed on the gate insulating film 103 sidewardly of the front gate electrode 102, and a source electrode 109 and a drain electrode 110 are connected to the areas 107 and 108, respectively, with the interlayer insulating film 105 interposed therebetween. Furthermore, an insulating film 111 is formed on the source electrode 109 and the drain electrode 110.

(Example of a Configuration of the Sampling Latch Circuit)

Figure 35:
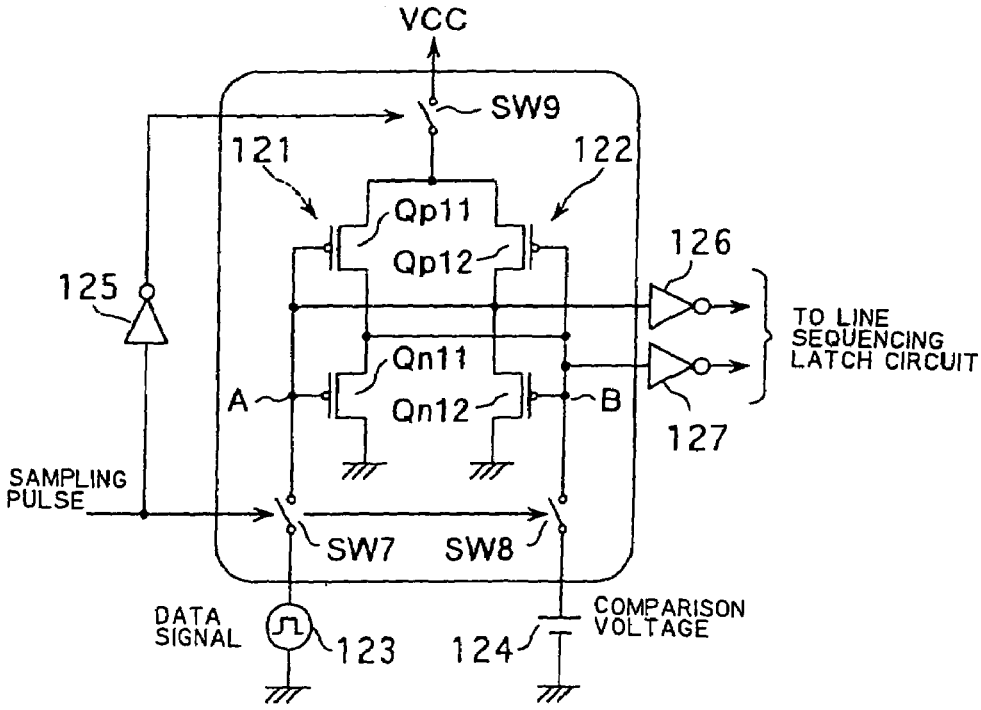
FIG. 35 is a circuit diagram showing an example of a particular configuration of a sampling latch circuit.
Figure 36:
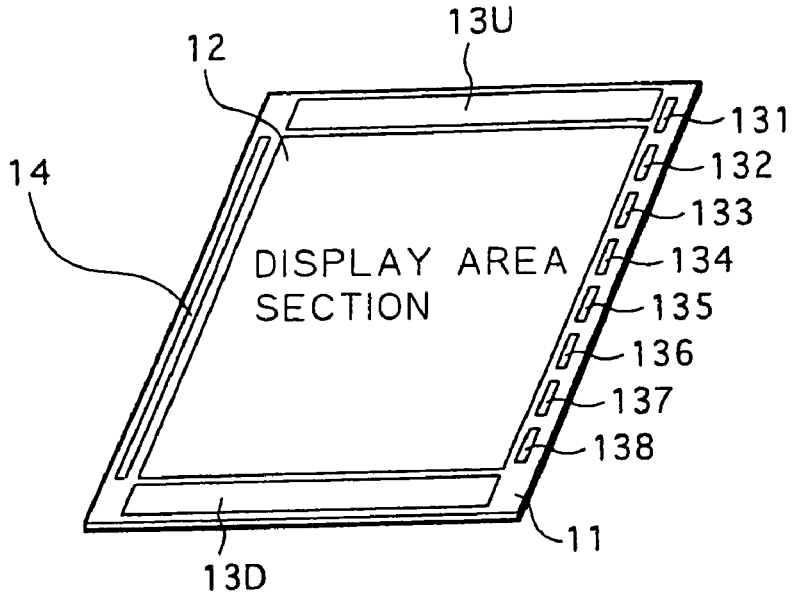
FIG. 36 is a schematic configuration view showing another example of a configuration of the display apparatus according to the present invention.

Here, as a particular example of a circuit which handles a signal of a small amplitude, a sampling latch circuit (corresponding to the sampling latch circuits 32U and 32D of FIG. 3) which uses, for example, a differential circuit is available. FIG. 35 is a circuit diagram of a particular example of a configuration of a sampling latch circuit.

The sampling latch circuit according to the present example has a comparator configuration wherein a CMOS inverter 121 including an Nch MOS transistor Qn11 and a Pch MOS transistor Qp11 whose gates and drains are individually connected commonly and another CMOS inverter 122 including an Nch MOS transistor Qn12 and a Pch MOS transistor Qp12 whose gates and drains are individually connected commonly are connected in parallel.

Here, an input terminal of the CMOS inverter 121 (a gate common node of the MOS transistors Qn11 and Qp11) and an output terminal of the CMOS inverter 122 (a drain common node of the MOS transistors Qn12 and Qp12) are connected to each other. Further, an input terminal of the CMOS inverter 122 (a gate common node of the MOS transistors Qn11 and Qp11) and an output terminal of the CMOS inverter 121 (a drain common node of the MOS transistors Qn12 and Qp12) are connected to each other.

Further, a data signal is inputted from a signal source 123 to the input terminal of the CMOS inverter 121 through a switch SW7, and a comparison voltage is applied from a voltage source 124 to the input terminal of the CMOS inverter 122 through a switch SW8. A power supply side common node of the CMOS inverters 121 and 122 is connected to a power supply VDD through a switch SW3. The switches SW7 and SW8 are switching-controlled directly with sampling pulses (supplied from the shift registers 31U and 31D of FIG. 3), and the switch SW9 is switching-controlled with an inverted pulse of the sampling pulse having passed through an inverter 145.

The potential at the gate node of the CMOS inverter 121, that is, at the node A, is inverted by an inverter 126 and supplied to a sequencing latch circuit (corresponding to the line sequencing latch circuit 33U or 33D of FIG. 3) in the next stage. The potential at the gate common node of the CMOS inverter 122, that is, at the node B, is inverted by another inverter 127 and supplied to the sequencing latch circuit in the next stage.

In the sampling latch circuit of the configuration described above, the CMOS inverter 121 and the CMOS inverter 122 form a comparator by a differential circuit. Accordingly, the Nch MOS transistor Qn11 and the Nch MOS transistor Qn12 operate in pair, and the Pch MOS transistor Qp11 and the Pch MOS transistor Qp12 operate in pair.

In this manner, in a transistor circuit wherein transistors operate in a pair such as a differential circuit, it is necessary to use transistors having same characteristics as the transistor pair. Thus, in the sampling latch circuit which uses a comparator of a differential circuit configuration, where the MOS transistors Qn11 and Qp11 of the CMOS inverter 121 and the MOS transistors Qn11 and Qp11 of the CMOS inverter 122 are configured using a TFT of the dual gate structure whose dispersion of the threshold voltage Vth is small, the reliability of the circuit can be raised and stabilized operation can be anticipated.

It is to be noted that, while, in the present example, the sampling latch circuit is configured such that the MOS transistors Qn11 and Qp11 of the CMOS inverter 121 and the MOS transistors Qn12 and Qp12 of the CMOS inverter 122 are produced using a TFT of the dual gate structure, application of the TFT of the dual gate structure is not limited to this, and where a TFT of the dual gate structure is used for transistors to be used as the switches SW7 and SW8, the reliability of the circuit can be raised and stabilized operation can be anticipated.

As a particular example of a circuit which handles a power supply voltage, that is, the power supply circuit 16, counter-electrode voltage generation circuit 17 and reference voltage generation circuit 18, the circuit configurations described above are available.

While the sampling latch circuits 32U and 32D are listed as examples of a circuit which handles a signal of a small amplitude and the power supply circuit 16, counter-electrode voltage generation circuit 17 and reference voltage generation circuit 18 are listed as examples of a circuit which handles a power supply voltage above, they are mere examples, and also other circuits may naturally be listed as an object of a circuit which is produced using a TFT of the dual gate structure.

As described above, where, in a liquid crystal display apparatus of the polycrystalline silicon TFT-active matrix type and the driving circuit integration type, at least one of those circuits which handle a signal of a small amplitude or those circuits which handle a power supply voltage, or some of those circuits which handle a signal of a small amplitude or some of those circuits which handle a power supply voltage, are produced using a TFT of the dual gate structure while the other circuits are produced using a TFT of the top gate structure or the bottom gate structure, a circuit having a high degree of reliability or a circuit having an augmented current capacity whose dispersion of the threshold voltage Vth is suppressed can be formed.

Further, since also those circuits which handle a signal of a small amplitude and those circuits which handle a power supply voltage are formed integrally on the same substrate together with the display area section 12, the number of interface terminals can be suppressed, and consequently, miniaturization and reduction of the cost of the set, reduction of the number of IC terminals and reduction of noise can be anticipated. Besides, where both of TFTs of the dual gate structure and TFTs of the top gate structure or/and the bottom gate structure are used, the circuit scale can be suppressed. Consequently, a driving circuit integration type display apparatus of a narrow frame can be implemented.

It is to be noted that, while, in the display apparatus according to the present invention, the timing generation circuit 15, power supply circuit 16, counter-electrode voltage generation circuit 17 and reference voltage generation circuit 18 are listed as peripheral circuits to be formed integrally on the glass substrate 11 same as that of the display area section 12, such other peripheral circuits as a CPU interface circuit 131, an image memory circuit 1322, an optical sensor circuit 133 and a light source driving circuit 134 can be listed in addition to them.

Here, the CPU interface circuit 131 is a circuit for inputting and outputting data from and to an external CPU. The image memory circuit 132 is a memory for storing image data, for example, still picture data, inputted from the outside through the CPU interface circuit 131. The optical sensor circuit 133 is a sensor for detecting the intensity of external light such as, for example, the brightness of the environment in which the present liquid crystal display apparatus is used, and supplies detection information thereof to the light source driving circuit 134. The light source driving circuit 134 is a circuit for driving a back light or front light for illuminating the display area section 12 and regulates the brightness of the light source based on intensity information of external light supplied thereto from the optical sensor circuit 133.

Also where such peripheral circuits 131 to 134 are formed integrally on the same glass substrate 11 together with the display area section 12, miniaturization and reduction of the cost of the apparatus can be anticipated if all of the circuit elements which compose the circuits mentioned or at least active elements (or active/passive elements) are produced on the glass substrate 11.

It is to be noted that, while, in the embodiments described above, description is given taking a case wherein the present invention is applied to a liquid crystal display apparatus of the active matrix type as an example, the present invention is not limited to this and can be similarly applied also to other display apparatus of the active matrix type such as an electroluminescence (EL) display apparatus wherein an EL element is used as an electro-optical element of each pixel.

Further, the display apparatus of the active matrix type according to the embodiments described above are applied as a display unit for OA equipment such as a personal computer or a word processor or for a television receiver or the like and are further used suitably as an output display section for a portable terminal such as a portable telephone set or a PDA for which miniaturization and compaction of an apparatus body are being proceeded.

Figure 37:
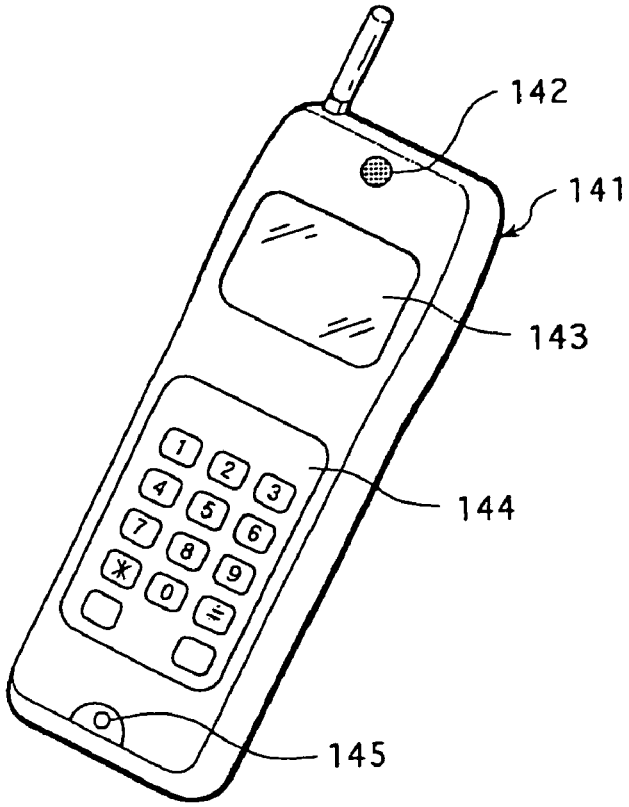
FIG. 37 is a view of an appearance showing a general configuration of a portable telephone set which is a portable terminal to which the present invention is applied.

FIG. 37 is a view of an appearance showing an outline of a configuration of a portable terminal, for example, a portable telephone set, to which the present invention is applied.

The portable telephone set according to the present example is configured such that a speaker section 142, an output display section 143, an operation section 144 and a microphone section 145 are disposed in order from the upper side on a front face side of an apparatus housing 141. In the portable telephone set having such a configuration as just described, for example, a liquid crystal display apparatus is used for the output display section 143, and as this liquid crystal display apparatus, a liquid crystal display apparatus of the active matrix type according to any of the embodiments described above is used.

Where, in a portable terminal such as a portable telephone set, a liquid crystal display apparatus of the active matrix type according to any of the embodiments described above is used for the output display section 143 in this manner, the circuit configuration of the timing generation circuit incorporated in the liquid crystal display apparatus can be simplified and miniaturization, reduction of the cost and reduction of the power consumption can be anticipated. Further, since the liquid crystal display apparatus has a narrow frame and the component circuit has a characteristic of a superior performance, miniaturization of the apparatus body, reduction of the cost, reduction of the power consumption and improvement of the performance can be anticipated.

INDUSTRIAL APPLICABILITY

As described above, according to the present invention, since a timing generation circuit, a display apparatus of the active matrix type in which the timing generation circuit is incorporated or a portable terminal wherein the display apparatus is used as a display section is configured such that a timing signal to be used by at least one of a vertical driving circuit and a horizontal driving circuit is produced based on timing information produced by at least one of the vertical driving circuit and the horizontal driving circuit, a portion of at least one of the vertical driving circuit and the horizontal driving circuit can be simplified in circuit configuration by an amount as the portion can be used commonly for production of the timing signal, and consequently, miniaturization, reduction of the cost and reduction of the power consumption of the set can be anticipated.

The invention claimed is:

1. A display apparatus comprising: a display area section wherein pixels each having an electro-optical element are disposed in rows and columns, a vertical driving circuit for selecting said pixels of said display area section in a unit of a row and a horizontal driving circuit for supplying an image signal to each of the pixels of the row selected by said vertical driving circuit are formed integrally on the same substrate, characterized in that a shift register which forms said horizontal driving circuit is disposed on the outermost side with respect to said display area section, and a clock line for transmitting a single-phase transfer clock to transfer stages of said shift registers is wired on the further outer side of said shift register, characterized in that a switch is interposed between each of the transfer stages of said shift register and said clock line for selectively supplying the single-phase transfer clock to the transfer stage of said shift register, and wherein each of the transfer stages of said shift register comprises a clocked inverter and a clock selection control circuit.

2. A display apparatus of the active matrix type according to claim 1, characterized in that a clock production circuit for dividing a dot clock into two to produce the single-phase transfer clock is provided on said same substrate.

3. A display apparatus according to claim 1, characterized in that a pair of said horizontal driving circuits are disposed along two sides of said display area section.

4. The display apparatus according to claim 1, wherein said clocked inverter latches said single-phase transfer clock supplied thereto through said switch.

5. The display apparatus according to claim 1, wherein said clock selection control circuit of a current transfer stage that controls said switch is based on a clocked inverter output of a preceding transfer stage and a clocked inverter output of the current transfer stage.

* * * * *